US008640372B2

(12) United States Patent
Hochstrate et al.

(10) Patent No.: US 8,640,372 B2
(45) Date of Patent: Feb. 4, 2014

(54) AUTOMATIC OR SEMI-AUTOMATIC RIFLE

(75) Inventors: Paul Hochstrate, Plantsville, CT (US); Laurance Robbins, Plainville, CT (US); Arthur F. Daigle, Plymouth, CT (US)

(73) Assignee: Colt Defense, LLC, West Hartford, CT (US)

( * ) Notice: Subject to any disclaimer, the term of this patent is extended or adjusted under 35 U.S.C. 154(b) by 0 days.

(21) Appl. No.: 13/291,714

(22) Filed: Nov. 8, 2011

(65) Prior Publication Data

US 2012/0111183 A1 May 10, 2012

Related U.S. Application Data

(63) Continuation of application No. 11/352,036, filed on Feb. 9, 2006, now Pat. No. 8,051,595, which is a continuation-in-part of application No. 11/154,738, filed on Jun. 16, 2005, now Pat. No. 7,131,228.

(60) Provisional application No. 60/580,256, filed on Jun. 16, 2004.

(51) Int. Cl.
*F41A 21/00* (2006.01)

(52) U.S. Cl.
USPC ..... 42/75.01; 42/75.03; 42/85; 42/90; 42/125; 42/111; 89/191.01; 89/179

(58) Field of Classification Search
USPC ..... 42/75.01–75.03, 85, 90; 89/179, 89/191.01–193
See application file for complete search history.

(56) References Cited

U.S. PATENT DOCUMENTS

| | | | | |
|---|---|---|---|---|
| 2,447,091 | A | 8/1948 | Pope | |
| 2,451,514 | A | 10/1948 | Sieg | |
| 2,543,766 | A | 3/1951 | Davis, Jr. | |
| 2,953,066 | A * | 9/1960 | Colby | 89/186 |
| 3,198,076 | A | 8/1965 | Stoner | |
| 3,323,246 | A | 6/1967 | Loffler | |
| 3,592,101 | A * | 7/1971 | Vartanian et al. | 89/193 |
| 3,611,607 | A | 10/1971 | Donnell | |
| 3,618,457 | A * | 11/1971 | Miller | 89/185 |
| 3,709,092 | A | 1/1973 | Tazome | |
| 3,731,417 | A | 5/1973 | Moller et al. | |
| 3,739,515 | A | 6/1973 | Koon, Jr. | |
| 3,810,412 | A | 5/1974 | Zamacola | |

(Continued)

FOREIGN PATENT DOCUMENTS

| | | | |
|---|---|---|---|
| WO | 2006138106 | A2 | 12/2006 |
| WO | 2009082520 | A2 | 7/2009 |

OTHER PUBLICATIONS

Bushmaster Firearms, Bushmaster Owner's Manual, http://www.bushmaster.com/electronic-documents/ACR-owners-manual.pdf.

(Continued)

*Primary Examiner* — Samir Abdosh
(74) *Attorney, Agent, or Firm* — Cantor Colburn LLP

(57) ABSTRACT

A rifle having a receiver with an integral hand guard and a barrel. The barrel is connected to the receiver. The hand guard extends over and surrounds the barrel. A removable hand guard is attached to the receiver by an attachment that stably holds the removable hand guard to the receiver. The attachment is arranged for allowing detachment and removal of the removable hand guard from the receiver without removal of fasteners.

18 Claims, 39 Drawing Sheets

(56) References Cited

U.S. PATENT DOCUMENTS

| | | | | |
|---|---|---|---|---|
| 3,830,003 | A | 8/1974 | Clerke | |
| 4,174,654 | A | 11/1979 | Liedke | |
| 4,297,800 | A | 11/1981 | Atchisson | |
| 4,563,937 | A | 1/1986 | White | |
| 4,756,228 | A | 7/1988 | Rath | |
| 4,765,224 | A | 8/1988 | Morris | |
| 4,817,496 | A | 4/1989 | Zedrosser | |
| 5,010,676 | A | 4/1991 | Kennedy | |
| 5,155,284 | A | 10/1992 | Flashkes | |
| 5,173,564 | A | 12/1992 | Hammond, Jr. | |
| 5,305,539 | A * | 4/1994 | Von Kuster | 42/75.01 |
| 5,343,650 | A * | 9/1994 | Swan | 42/117 |
| 5,590,484 | A | 1/1997 | Mooney et al. | |
| 5,634,288 | A | 6/1997 | Martel | |
| 5,711,102 | A | 1/1998 | Plaster et al. | |
| 5,824,943 | A | 10/1998 | Guhring et al. | |
| 5,826,363 | A * | 10/1998 | Olson | 42/75.01 |
| 5,900,577 | A | 5/1999 | Robinson et al. | |
| 6,212,814 | B1 | 4/2001 | Lambie | |
| 6,250,194 | B1 | 6/2001 | Brandl et al. | |
| 6,260,748 | B1 | 7/2001 | Lindsey | |
| 6,293,040 | B1 | 9/2001 | Luth | |
| 6,308,609 | B1 | 10/2001 | Davies | |
| 6,314,672 | B2 | 11/2001 | Murello et al. | |
| 6,481,144 | B1 | 11/2002 | Chee et al. | |
| 6,487,805 | B1 | 12/2002 | Reynolds | |
| 6,487,806 | B2 | 12/2002 | Murello et al. | |
| 6,490,822 | B1 * | 12/2002 | Swan | 42/71.01 |
| 6,499,245 | B1 * | 12/2002 | Swan | 42/71.01 |
| 6,508,027 | B1 | 1/2003 | Kim | |
| 6,609,319 | B1 | 8/2003 | Olson | |
| 6,609,321 | B2 * | 8/2003 | Faifer | 42/71.01 |
| 6,618,976 | B1 | 9/2003 | Swan | |
| 6,671,990 | B1 | 1/2004 | Booth | |
| 6,694,660 | B1 * | 2/2004 | Davies | 42/75.01 |
| 6,779,288 | B1 | 8/2004 | Kim | |
| 6,792,711 | B2 | 9/2004 | Battaglia | |
| 6,836,990 | B2 | 1/2005 | Shiloni | |
| 6,895,708 | B2 * | 5/2005 | Kim et al. | 42/72 |
| 7,059,076 | B2 * | 6/2006 | Stoner et al. | 42/75.01 |
| 7,131,228 | B2 | 11/2006 | Hochstrate et al. | |
| 7,137,217 | B2 | 11/2006 | Olson et al. | |
| RE39,465 | E * | 1/2007 | Swan | 42/71.01 |
| 7,313,883 | B2 | 1/2008 | Leitner-Wise | |
| 7,328,530 | B2 * | 2/2008 | Griffin | 42/105 |
| RE40,216 | E | 4/2008 | Swan | |
| 7,363,741 | B2 * | 4/2008 | DeSomma et al. | 42/85 |
| 7,444,775 | B1 | 11/2008 | Schuetz | |
| 7,523,580 | B1 | 4/2009 | Tankersley | |
| 7,574,823 | B2 | 8/2009 | Nakayama | |
| 7,584,567 | B1 | 9/2009 | DeSomma et al. | |
| 7,596,900 | B2 | 10/2009 | Robinson et al. | |
| 7,640,689 | B2 | 1/2010 | Fluhr | |
| 7,716,865 | B2 | 5/2010 | Daniel et al. | |
| 7,810,271 | B2 | 10/2010 | Patel | |
| 8,051,595 | B2 | 11/2011 | Hochstrate et al. | |
| 8,069,607 | B2 * | 12/2011 | Ballard | 42/140 |
| 2002/0000059 | A1 | 1/2002 | Murello et al. | |
| 2003/0074822 | A1 * | 4/2003 | Faifer | 42/71.01 |
| 2003/0150151 | A1 | 8/2003 | Orth | |
| 2004/0049964 | A1 | 3/2004 | Vais | |
| 2005/0188591 | A1 | 9/2005 | Stone | |
| 2005/0235546 | A1 | 10/2005 | Wonisch et al. | |
| 2005/0262752 | A1 | 12/2005 | Robinson et al. | |
| 2005/0268513 | A1 * | 12/2005 | Battaglia | 42/71.01 |
| 2006/0032103 | A1 | 2/2006 | Wossner et al. | |
| 2006/0236582 | A1 | 10/2006 | Lewis et al. | |
| 2006/0277810 | A1 * | 12/2006 | Leitner-Wise | 42/75.03 |
| 2007/0033851 | A1 * | 2/2007 | Hochstrate et al. | 42/75.01 |
| 2007/0199435 | A1 * | 8/2007 | Hochstrate et al. | 89/191.02 |
| 2008/0134559 | A1 * | 6/2008 | Swan | 42/90 |
| 2008/0301994 | A1 * | 12/2008 | Langevin et al. | 42/71.01 |
| 2009/0000173 | A1 | 1/2009 | Robinson et al. | |
| 2009/0007477 | A1 | 1/2009 | Robinson et al. | |
| 2009/0013579 | A1 * | 1/2009 | Fluhr | 42/71.01 |
| 2009/0031605 | A1 | 2/2009 | Robinson | |
| 2009/0031606 | A1 | 2/2009 | Robinson et al. | |
| 2009/0031607 | A1 | 2/2009 | Robinson et al. | |
| 2009/0056191 | A1 * | 3/2009 | Battaglia | 42/71.01 |
| 2009/0223357 | A1 * | 9/2009 | Herring | 89/192 |
| 2010/0000400 | A1 * | 1/2010 | Brown | 89/191.01 |
| 2010/0095833 | A1 | 4/2010 | Gavage et al. | |
| 2010/0095834 | A1 * | 4/2010 | Kuczynko et al. | 89/193 |
| 2010/0126054 | A1 | 5/2010 | Daniel et al. | |
| 2010/0186278 | A1 | 7/2010 | Daniel | |
| 2012/0111183 | A1 * | 5/2012 | Hochstrate et al. | 89/193 |

OTHER PUBLICATIONS

Mega Arms, Monolithic Tactical System, http://www.megamachineshop.com/pdf/MTS-ASSEMBLY-INSTRUCTIONS.pdf.

Monkey Wrench, A Closer Look at the MGI QCB-D Upper Receiver, http://referenceonly.wordpress.com/2010/10/09/a-closer-look-at-the-mgi-qcb-d-upper-receiver/.

Remington Defense, RGP Brochure, http://www.remingtonmilitary.com/Firearms/Carbines/RGP.aspx.

CZ, CZ Military Catalogue, http://www.czub.cz/zbrojovka/cz-catalogue/Military_catalogue.pdf.

"Small Arms of the World", 12th Revised Edition, Copyright 1983, Barnes & Noble, 8 pages.

Supplementary European Search Report dated Nov. 14, 2011.

* cited by examiner

AUTOMATIC OR SEMI-AUTOMATIC RIFLE

CROSS-REFERENCE TO RELATED APPLICATION(S)

This application is a continuation of U.S. patent application Ser. No. 11/352,036 filed Feb. 9, 2006, now U.S. Pat. No. 8,051,595 which is a continuation in part of U.S. patent application Ser. No. 11/154,738 filed Jun. 16, 2005, now U.S. Pat. No. 7,131,228 which claims the benefit of U.S. Provisional Patent Application Ser. No. 60/580,256 filed Jun. 16, 2004, the contents each of which are incorporated herein by reference thereto.

BACKGROUND

1. Field

The disclosed embodiments relate to an improved rifle and its law enforcement and commercial variances and, more particularly, to an improved military rifle having modular subassemblies.

2. Brief Description of Earlier Developments

There are conventional firearms with an integral upper receiver and hand guard. The conventional firearms have a removable hand guard section fastened to the hand guard on the upper receiver with screws or other similar fasteners. Field removal/reinstallation of the conventional hand guard section hence involves removal/installation tools (for example screw drivers), and once removed the mounting screws may be lost. This is not desirable in operational conditions. Further, conventional firearms with an upper receiver having an integral hand guard, may encumber field removal and replacement of the barrel. By way of example, in a conventional military rifle, for example an "M-4"™ rifle available from Colt Defense having an upper receiver with integral hand guard, the barrel nut (fastening the barrel to the receiver) may be covered or "buried" within the hand guard thereby limiting accessibility to the barrel nut. Moreover, conventional barrel nuts may have features such as peripheral clearance slots, for the gas tube or operating rod of an indirect gas operating system, that further impair accessibility to surface or features of the barrel nut engaged in order to apply tightening or untightening torque to the barrel nut. As may be realized, rotation of the conventional barrel nut, such as at removal/replacement of the barrel, may involve additional undesired disassembly of the firearm systems. By way of example, the gas tube, or operating rod of an indirect gas operating system may have to be removed from the firearm in order to allow rotation of the barrel nut for nut removal. In other words, the operating rod or gas tube may have to be removed prior to barrel removal. Similarly, on reinstallation, the barrel and at least the operating rod of the firearm indirect gas operating system, or the gas tube may have to be assembled/connected to the receiver in sequence, rather than in unison, in order to allow rotation of the barrel nut. This is not desired. Further still, the interface between the barrel, receiver and barrel nut in conventional firearms may result in the barrel being eccentrically positioned in an uncontrolled manner relative to the mating bore of the receiver. This also is undesired. The exemplary embodiments disclosed herein overcome the problems conventional firearms as will be described further below.

SUMMARY OF THE EMBODIMENTS

In accordance with one exemplary embodiment, an automatic or semiautomatic rifle is provided. The has a receiver with an integral hand guard and a barrel. The barrel is connected to the receiver. The hand guard extends over and surrounds the barrel. A removable hand guard is attached to the receiver by an attachment that stably holds the removable hand guard to the receiver. The attachment is arranged for allowing detachment and removal of the removable hand guard from the receiver without removal of fasteners.

In accordance with another exemplary embodiment a semi-automatic rifle is provided. The rifle has a receiver, a barrel, a removable accessory device mounting rail, and a quick release lock. The receiver has an integral hand guard portion. The barrel is removably connected to the receiver. The removable accessory device mounting rail is removably connected to the receiver. The hand guard extends over and surrounds the barrel. The rail has another hand guard portion matable with the integral hand guard portion of the receiver. The quick release lock is mounted to at least one of the removable mounting rail or the receiver for locking the rail to the receiver.

In accordance with another exemplary embodiment a semi-automatic or automatic rifle is provided. The rifle comprises a receiver, a barrel and a barrel nut. The receiver has a frame of unitary construction with an integral hand guard section. The barrel is removably connected to the receiver frame. The integral hand guard section extends over and generally surrounds the barrel.

The barrel nut is connected to the barrel for removably attaching the barrel to the receiver. The barrel nut has barrel engagement surfaces disposed to engage and hold the barrel to the receiver.

In accordance with another exemplary embodiment an automatic or semiautomatic rifle is provided. The rifle has a receiver, a barrel connected to the receiver, and a gas piston operating system assembly. The receiver has a firing mechanism. The gas piston operating system assembly connects the barrel to the receiver for cycling the firing mechanism is automatic or semi-automatic operation. The gas piston operating system assembly is removable as a unit from the barrel and receiver.

BRIEF DESCRIPTION OF THE DRAWINGS

The foregoing aspects and other features of the exemplary embodiments are explained in the following description, taken in connection with the accompanying drawings, wherein.

DETAILED DESCRIPTION OF THE EXEMPLARY EMBODIMENT(S)

Figure 1:
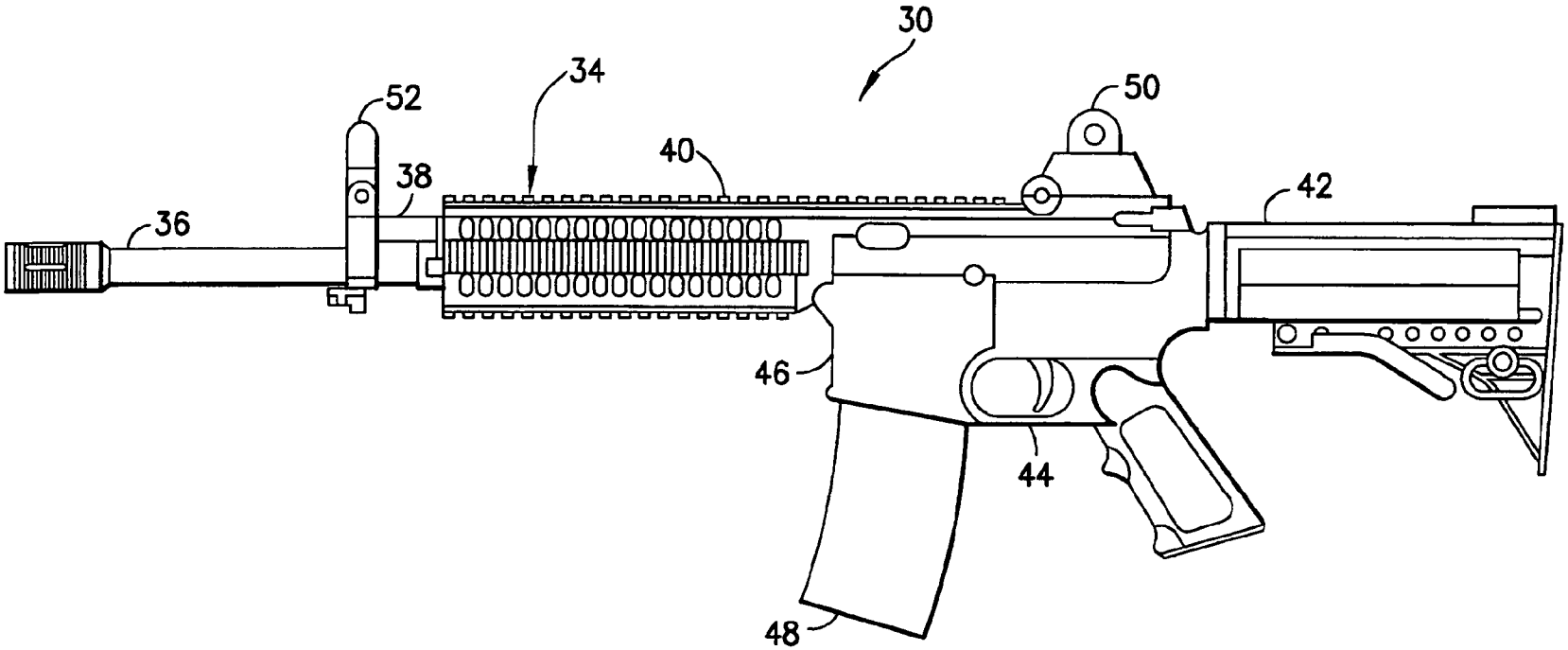
FIG. 1 is a side elevation view of an automatic firearm incorporating features in accordance with an exemplary embodiment.

Referring to FIG. 1, there is shown, a side elevation view of an automatic firearm 30 capable of automatic or semiautomatic fire incorporating features in accordance with an exemplary embodiment of the present invention. Although the present invention will be described with reference to the embodiments shown in the drawings, it should be understood that the present invention can be embodied in many alternate forms of embodiments. In addition, any suitable size, shape or type of elements or materials could be used.

Firearm 30 may be gas operated, like examples, such as the M-4™ or M-16 type or similar commercial variants thereof. Firearm 30 may have operational features such as disclosed in U.S. Pat. Nos. 5,726,377, 5,760,328, 4,658,702, 4,433,610, U.S. Non Provisional patent application Ser. No. 10/836,443 filed Apr. 30, 2004, and U.S. Provisional Patent Application 60/564,895 filed Apr. 23, 2004, all of which are hereby incorporated by reference herein in their entirety. The firearm 30 and its sections described in greater detail below is merely exemplary. In alternate embodiments the firearm 30 may have other sections, portions or systems. Firearm 30 may have an upper receiver section 34 a barrel 36, gas tube 38, and hand guard 40. In alternate embodiments, the firearm may have an indirect gas operating system or gas piston system. In that event, the gas tube may be replaced by a gas operated linkage actuating the bolt carriage in the upper receiver. Firearm 30 may incorporate stock 42, lower receiver section 44, magazine well 46, clip or magazine 48 and rear and front sights 50, 52. As will be described below, upper receiver 34 having barrel 36, lower receiver 44 and magazine well 46 are modular and configurable such that firearm 30 comprises a modular rifle design. In addition, lower receiver 44 and magazine well 46 may be removable without tools or fasteners. In alternate embodiments, more or less modules and assemblies may be removable without tools or fasteners. As an example, magazine well 46 may be replaceable and removable such that magazine well 46 may be replaced with a different magazine well to change caliber. Additionally, modularity with interlocking components is provided for ease of assembly and disassembly without affecting fire accuracy as well as to provide a single configurable firearm without having to support multiple firearms. Further, the hand guard, and accessory mounting rails thereon, may be integral with the upper receiver and the integral upper receiver, hand guard and mounting rails may be of unitary construction.

Figure 2:
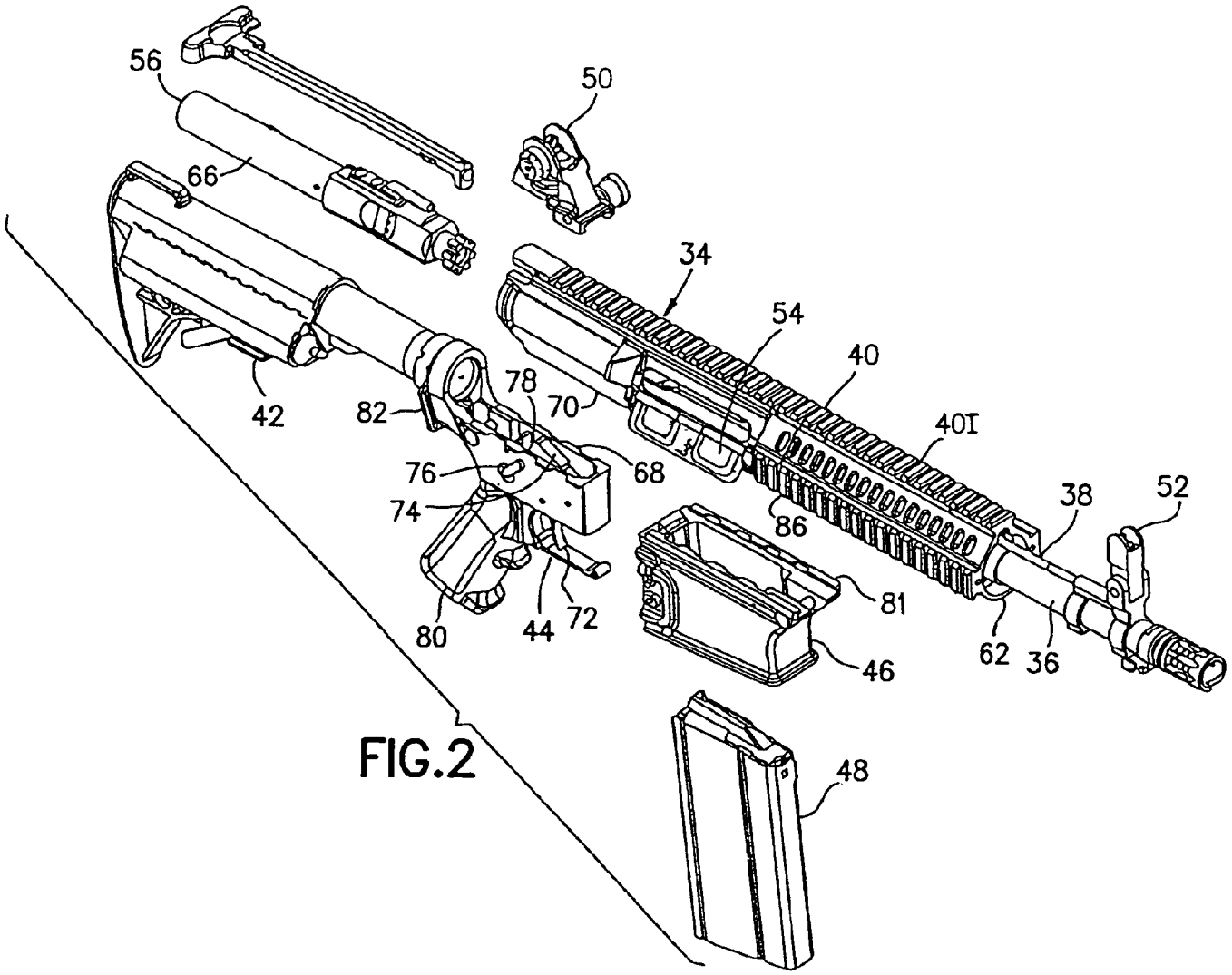
FIG. 2 is an exploded isometric view of the automatic firearm shown in FIG. 1.

Referring now to FIG. 2, there is shown an exploded isometric view of the automatic firearm shown in FIG. 1. As noted before, firearm 30 generally incorporates an upper receiver section 34, barrel 36, gas tube 38, hand guard 40, rear and front sights 50, 52, ejection port cover attachment 54 and bolt assembly 56. Firearm 30 may incorporate stock 42, lower receiver section 44, magazine well 46, clip or magazine 48 and auto sear actuator 66 assembled to the bolt carrier (not shown). The barrel 36 and/or the bolt/bolt carrier 56 may be coupled to upper receiver section using conventional splined and/or threaded/pinned locking techniques or otherwise. Hand guard 40 may have features such as disclosed in U.S. Pat. Nos. 4,663,875 and 4,536,982, both of which are hereby incorporated by reference herein in their entirety. Hand guard 40 has features for mounting additional devices on one or more rails as shown and may be configured with such rails as a "Piccatiny Rail" configuration as described in Military Standard 1913, which is hereby incorporated by reference herein in its entirety. The hand guard and rails may be made from any suitable material such as hard coat anodized aluminum as an example. Hand guard 40 may be configured for basic mission profiles or light duty rail requirements while simplifying techniques such as the Gun/Light technique with firearms such as the M-4™. The peripheral devices may be devices such as sights, illumination devices, vision enhancing devices, launchers, laser aiming devices, Global Positioning or aiming devices or otherwise. In alternate embodiments, more or less similar or different devices may be provided and more or less rail(s) may be provided. In the exemplary embodiment shown in FIG. 2, upper receiver 34 may be of one-piece, or unitary construction incorporating integral hand guard section 40I having fixed rails for example at the three, nine and twelve o'clock positions relative to the barrel axis. In alternate embodiments, the rails may be positioned as desired. Hand guard 40 has a removable bottom portion 60 with integral lower rail 60R for different mounting options that may be provided. In this embodiment the rail 60R may be located at the six (6) o'clock position relative to the barrel axis, though in alternate embodiments the removable rail may be located in any other desired location. The bottom portion 60 may be removable to install other accessories, such a grenade launcher as an example. The removable bottom portion having an integral rail is mounted using a keyed/key way system or tongue and groove system that will be described in more detail below. In the exemplary embodiment shown in FIG. 2, support ring 62 is provided at the front of the receiver 34 for strength and attachment purposes. Lower receiver 44 has interface 68 that removably interlocks with mating interface 70 of upper receiver 34. Interfaces 68, 70 may have a tabbed rim lips that slide relative to each other to lock and unlock allowing the user to lock/assemble and unlock/disassemble the two assemblies without tools and without other disassembly. Interface 68 has features that mate with features on interface 70 that allow lower receiver 44 and upper receiver 34 to be mated and then slid into a locked position for coupling. To de couple lower receiver 44 and upper receiver 34, a clip or pin is depressed, lower receiver 44 is slid relative to upper receiver 34 and the two separated. In this manner the two portions are coupled and de coupled without fasteners or special tools. In alternate embodiments, other mating and locking features could be provided. In this manner, the modular lower receiver interlocks with the modular upper receiver and different receivers with the same interface can be interchanged without further disassembly. Lower receiver 44 has features such as trigger 72, hammer 74, fire control selector 76, auto sear 78. Lower receiver 44 may have integral grip 80 and fixtures 82 for mounting stock 42. Magazine well 46 has interface 84 that removably interlocks with mating interface 86 of upper receiver 34. Interface 86 may be similar to or the same as interfaces 70 or 68 or may be different. Interfaces 84, 86 may have a tabbed rim lips that slide relative to each other to lock and unlock allowing the user to lock/assemble and unlock/disassemble the two assemblies without tools and without other disassembly. Interface 84 has features that mate with features on interface 86 that allow magazine well 46 and upper receiver 34 to be mated and then slid into a locked position for coupling. To de couple magazine well 46 and upper receiver 34, a clip or pin is depressed, magazine well 46 is slid relative to upper receiver 34 and the two separated. In this manner the two portions are coupled and de coupled without fasteners. In alternate embodiments, other mating and locking features could be provided. In this manner, the modular magazine well 46 interlocks with the modular upper receiver and different receivers and wells with the same interface can be interchanged without further disassembly. Magazine well receiver module 46 is positioned in front of lower receiver 44 as shown and interfaces with a corresponding portion of upper receiver 34. Magazine well receiver module 46 may butt against a corresponding surface of lower receiver 44 and may accept the trigger guard of lower receiver 44 in a recess or in a snap-in fashion. With a conventional firearm, the user must disassemble the main components, in cases with separate fasteners whereas with the present invention, in a "snap and go" fashion, the user may interchange main components and subassemblies without special tools and with out fasteners. As an example, the firearm may be converted from a .223 caliber round to a 9 mm caliber round by replacing the barrel and magazine well and magazine without special tools or fasteners. As a further example, the firearm may be converted from a semi-automatic to automatic by replacing the lower receiver.

Figure 3:
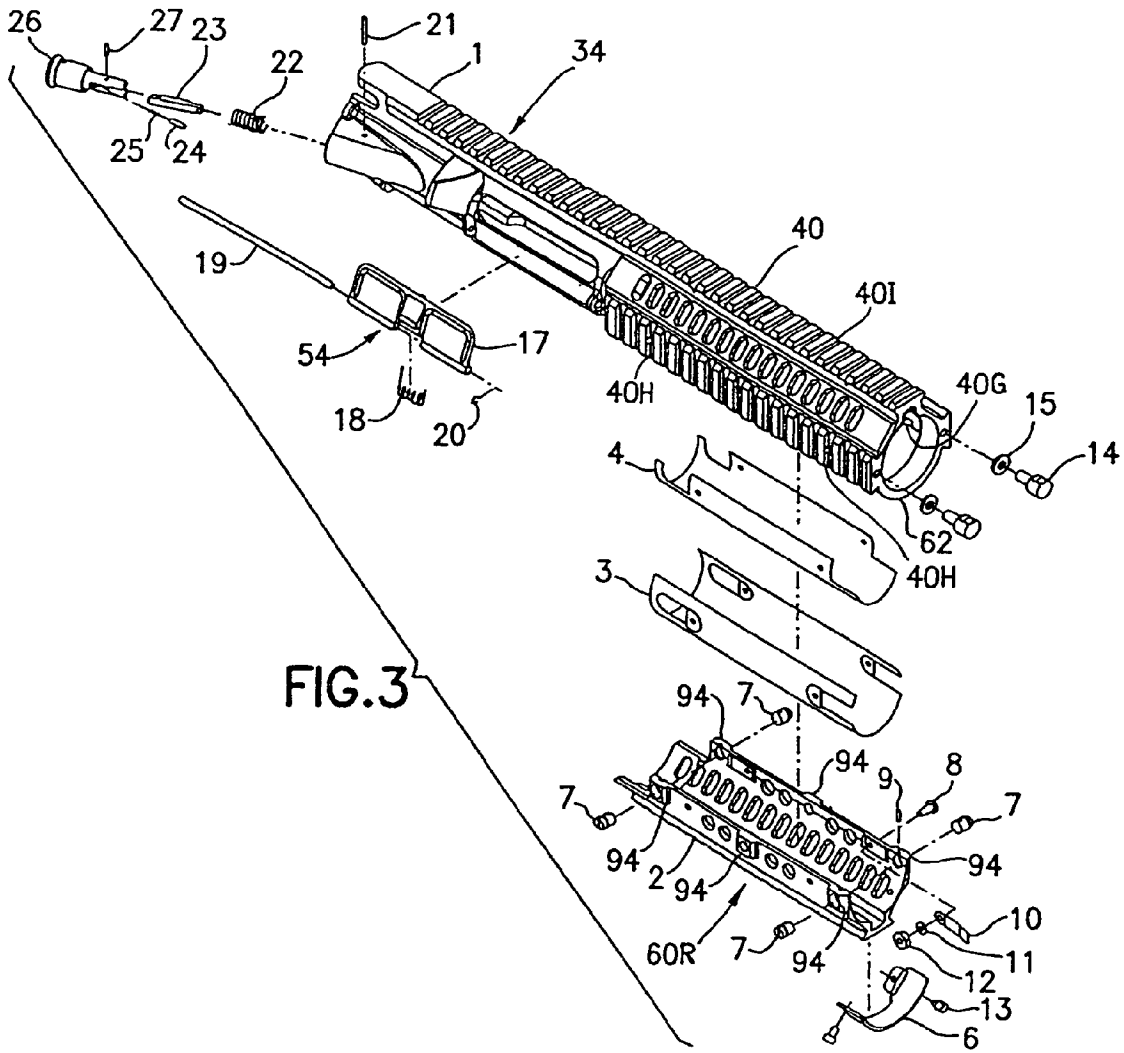
FIG. 3 is an exploded isometric view of the upper receiver with hand guard section of the firearm shown in FIG. 1.

Referring now to FIG. 3, there is shown an exploded isometric view of the unitary construction upper receiver 34 with integral hand guard section 40I of the firearm shown in FIG. 1. As may be realized, in alternate embodiments the upper receiver may be coupled conventionally to the lower receiver. Hand guard 40 (formed for example by the joined upper and lower sections 40I, 60) has vent holes, integral external rails, heat shields 3, 4 or double heat shields and liners (not shown) to facilitate cooling of the barrel 36 while keeping hand guard 40 at a temperature sufficiently low for an operator to hold. As noted before in this embodiment, the upper receiver 34 and hand guard 40I may be integrally formed as a single member of unitary construction, the one piece hand guard and upper receiver unit may be formed of any suitable metal, such as steel or Al alloy, or may be formed from non-metallic material such as plastic or composites. Rails are provided on Hand guard 40 and may be integrally molded. Hence, the "Piccatiny rails", hand guard and upper receiver may be integral as a one piece member of unitary construction. In alternate embodiments the rails may be removably mounted. In alternate embodiments, more or less multiple rails may be provided in multiple mounting locations or mounting angles on hand guard 40. The rails may be manufactured as part of upper receiver 34 such that collimating between the rail mounted device and the barrel centerline are maintained as desired. Rails are shown as left and right side rails for ambidextrous use. In alternate embodiments, rails may be mounted further forward or rearward or at different angles. Hand guard 40 allows attachment of a removable bottom portion 60 with lower rail 60R for different mounting options that may be provided. The removable bottom portion 60 with rail 60R may be mounted using a keyed/key way system or tongue and groove system. A heat shield may be secured to the upper portion using any suitable attachment means such as screws, pins, rivets. The bottom portion has spring loaded movable detents that lock the bottom portion to the upper portion 64OI. Accordingly, the bottom portion may be removably attached to the upper hand guard 40I with spring loaded locks that facilitate ease of removal and reattachment of the bottom and upper hand guard portions.

In the exemplary embodiment, spring tabs 10 (only 1 of 4 shown) are fastened to bottom portion 60 using fasteners 8, 11 and 12 to bias detents 7 outward to protrude past the outer portion of key 94 (4 of 6 places). Pin 9 (1 of 4 shown) engages a cammed recess in detent 7 such that when detent 7 is rotated, detent 7 moves against the spring tabs until flush with the outer portion of key 94. Each of keys 94 engages a mating recess or key way 40G (one shown in FIG. 3) in the upper portion of hand guard 40. Detents 7 engage mating holes 40H in the upper portion of hand guard 40 such that the lower portion 60 may be snapped into the upper portion of hand guard 40 and be positively located and coupled. Removal is accomplished by pressing in detents 7 (in the case where there are no camming surfaces and the detents 7 are simply retained) or rotating detents 7 to allow lower portion 60 to be separated from the upper portion of hand guard 40I. In alternate embodiments, other mating and locking features could be provided to couple lower portion 60 to upper portion 40I. Heat shields 3, 4 may be fastened to lower portion 60 using pins or screws or otherwise. Stop 6 may be provided and fastened using fasteners 13 to butt against support ring 62. As shown, support ring 62 may be provided at the front of the receiver assembly 34 for attachment purposes. Support ring 62 of the upper portion of the hand guard 40I provides a more stable assembly to facilitate manufacture as well as provides a section for the attachment of additional alternate attachments such as by using mounting features 14, 15 to couple attachments, such as a shoulder strap to ring 62.

Figure 4:
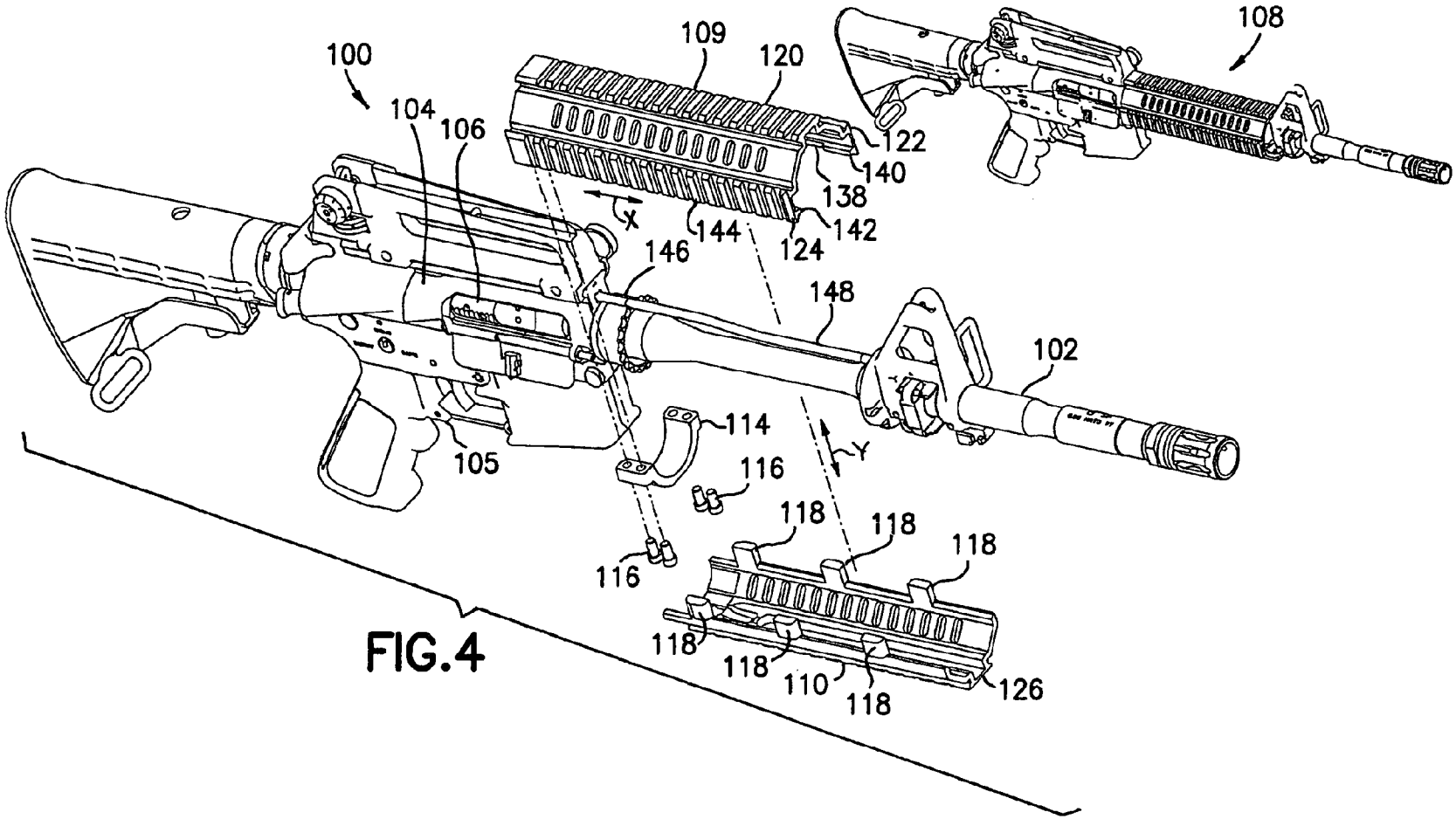
FIG. 4 is an exploded isometric view of an automatic firearm incorporating features in accordance with an exemplary embodiment.
Figure 5:
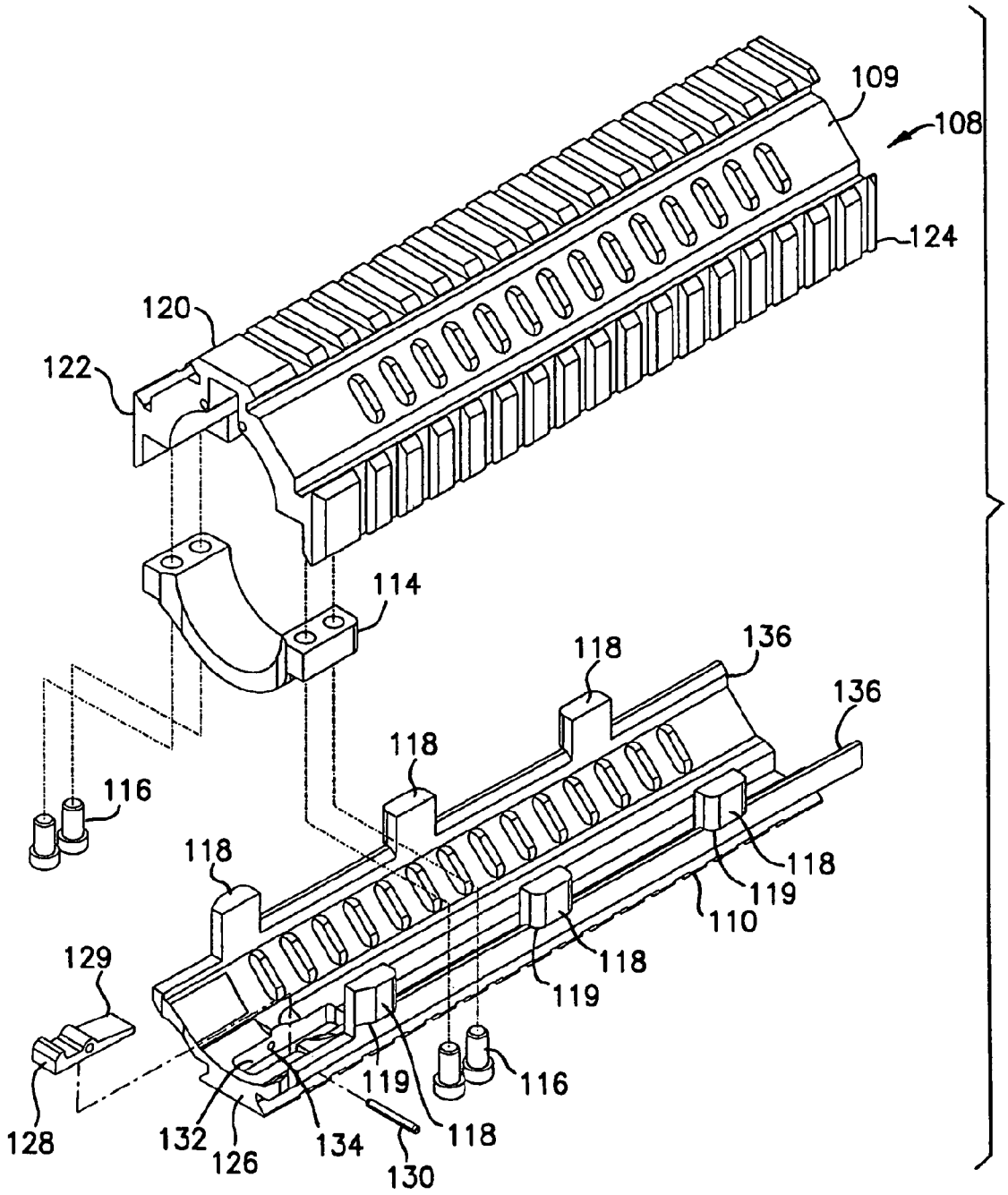
FIG. 5 is an exploded isometric view of the hand guard of the automatic firearm shown in FIG. 4.

Referring now to FIG. 4, there is shown an exploded isometric view of an automatic firearm incorporating features in accordance with an exemplary embodiment. Referring also to FIG. 5, there is shown an exploded isometric view of the hand guard of the automatic firearm shown in FIG. 4. Firearm 100 is generally similar to firearm 30 in FIG. 1, except as otherwise noted. Firearm 100 may have an upper receiver 104 with barrel 102 connected to upper receiver 104 with barrel nut 146. Firearm 100 may further have gas actuation system 148, lower receiver 105, hand guard 108, and bolt 106. Firearm 100 may have an operating mechanism in the receiver having a trigger, hammer, and fire control selector. Firearm 100 may have a magazine well provided at the front of lower receiver 105. In the exemplary embodiment shown hand guard 108 is provided having an upper portion 109 and removable lower hand guard portion 110. As may be realized hand guard 108 in this embodiment may be used to replace a conventional hand guard. Thus, hand guard 108 is retrofittable onto otherwise conventional M-4™ type rifles. As seen in FIGS. 4-5, upper portion 109 may be clamped to firearm 100 with clamp member 114 and fasteners 116. Clamp member 114 clamps upper hand guard portion 109 to barrel nut 146. In alternate embodiments, alternate mounting techniques may be provided. The removable clamp portion 114 provides frictional clamping with contact onto the body of barrel nut 146 and clears the scallops on barrel nut 146. A gas tube groove is provided on upper portion 120 for clearance and/or to provide positioning relative to the receiver. The width of lower clamp member 114 allows the clamp member to sit within the width of nut 146 to avoid interference with the gas tube scallop ring. Heat shields, similar to shields 3, 4 in FIG. 3, may be snap mounted or otherwise mounted to upper portion 109 and/or lower portion 110. In this embodiment upper portion 109 may for example have 9 o'clock rail 124, 12 o'clock rail 120 and 3 o'clock rail 122. In the exemplary embodiment, lower portion 110 has 6 o'clock rail 126. In alternate embodiments, the lower portion of the hand guard may have more or fewer accessory device mounting rails. In the embodiment shown, no support ring is shown on upper portion 109; in alternate embodiments a front support ring may be provided. Lower portion 110 is coupled to the upper portion 109 via tongue and groove mating. Access spaces or grooves 138, 144 are provided in upper portion 109 to mate insert tongues 118 into upper rail 109. Support surfaces 140, 142 engage surfaces 119 and are provided to allow retention of lower portion 110 by moving lower portion up (in the direction indicated by arrow Y) and then sliding lower portion 110 back (in the direction indicated by arrow X). In alternate embodiments, lower portion may be otherwise retained, for example, by sliding forward. Spring loaded latch 128 pivots on pin 130 and engages a detent or slot in the clamp 114 bottom surface. Here, Latch push pad 129 is recessed into rail 126. Grooves 136 may be provided to allow snap mounting of a heat shield. Here, lack of a support ring allows a shield to extend forward so that when installed front of shield becomes flush without a support ring in the way. An upper heat shield portion may be provided for attachment around the gas tube. Here, retrofittable rail 108 may be provided for attachment to an existing rifle. Here, a retrofittable four position rail is provided that may be put on an existing rifle or cartridge.

Figure 6:
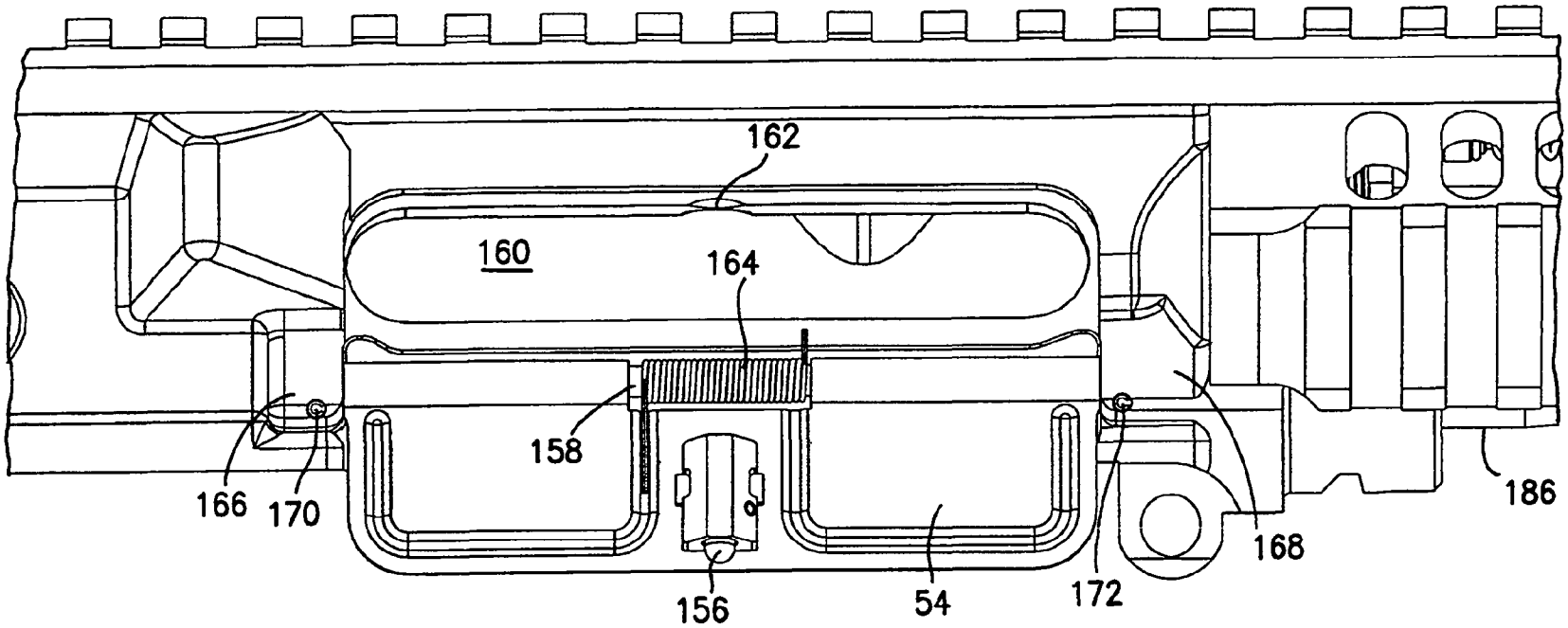
FIG. 6 is a side elevation view of an ejection port cover.
Figure 7:
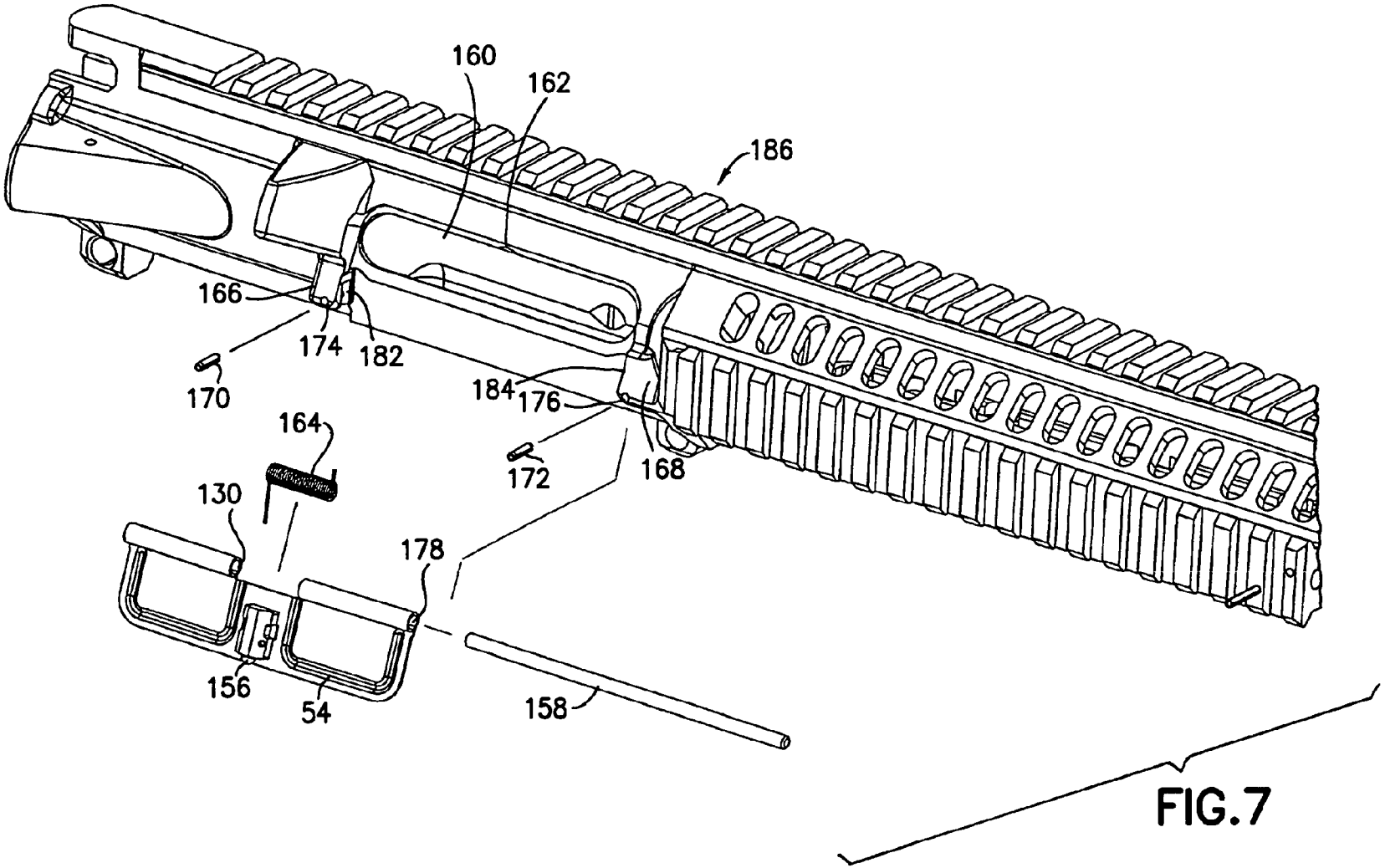
FIG. 7 is an exploded view of the ejection port cover shown in FIG. 6.
Figure 8:
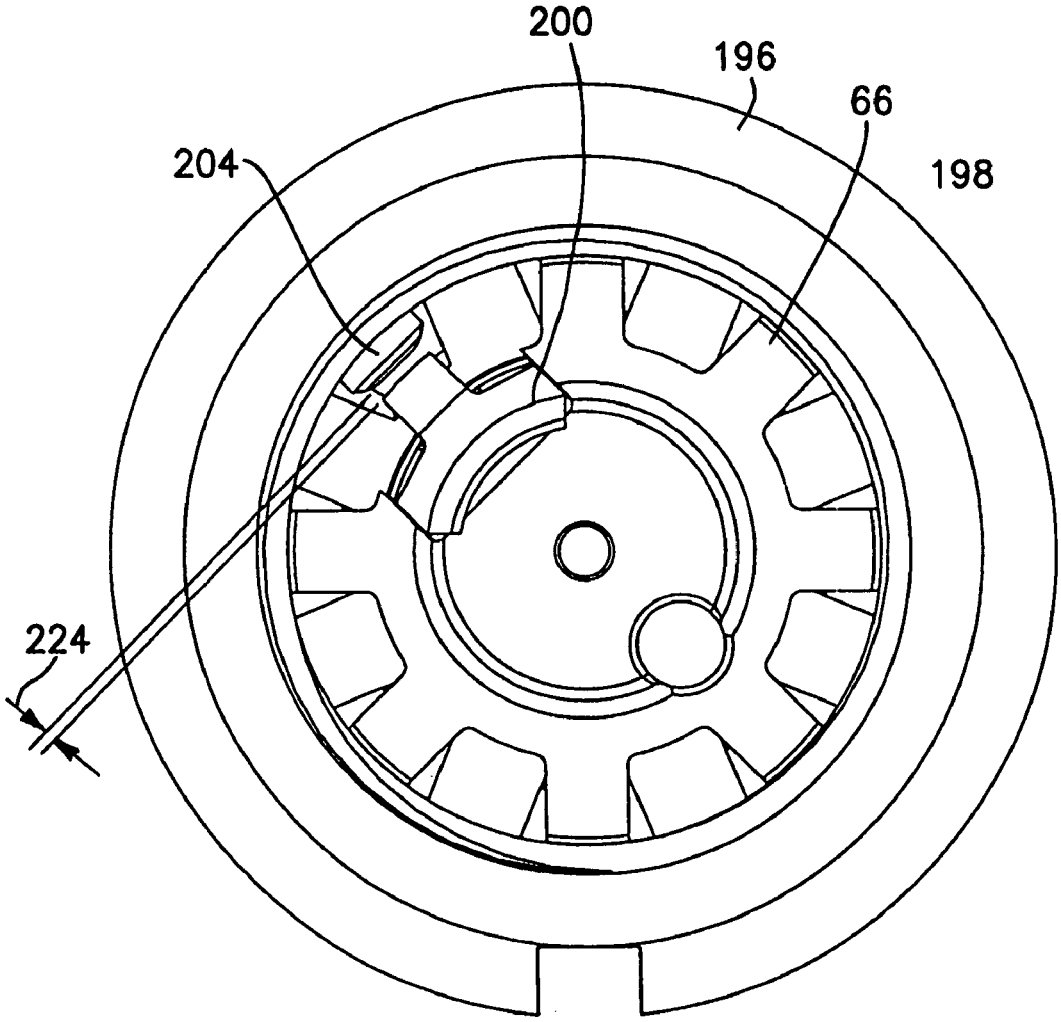
FIG. 8 is a view of a barrel extension and bolt carrier.
Figure 9:
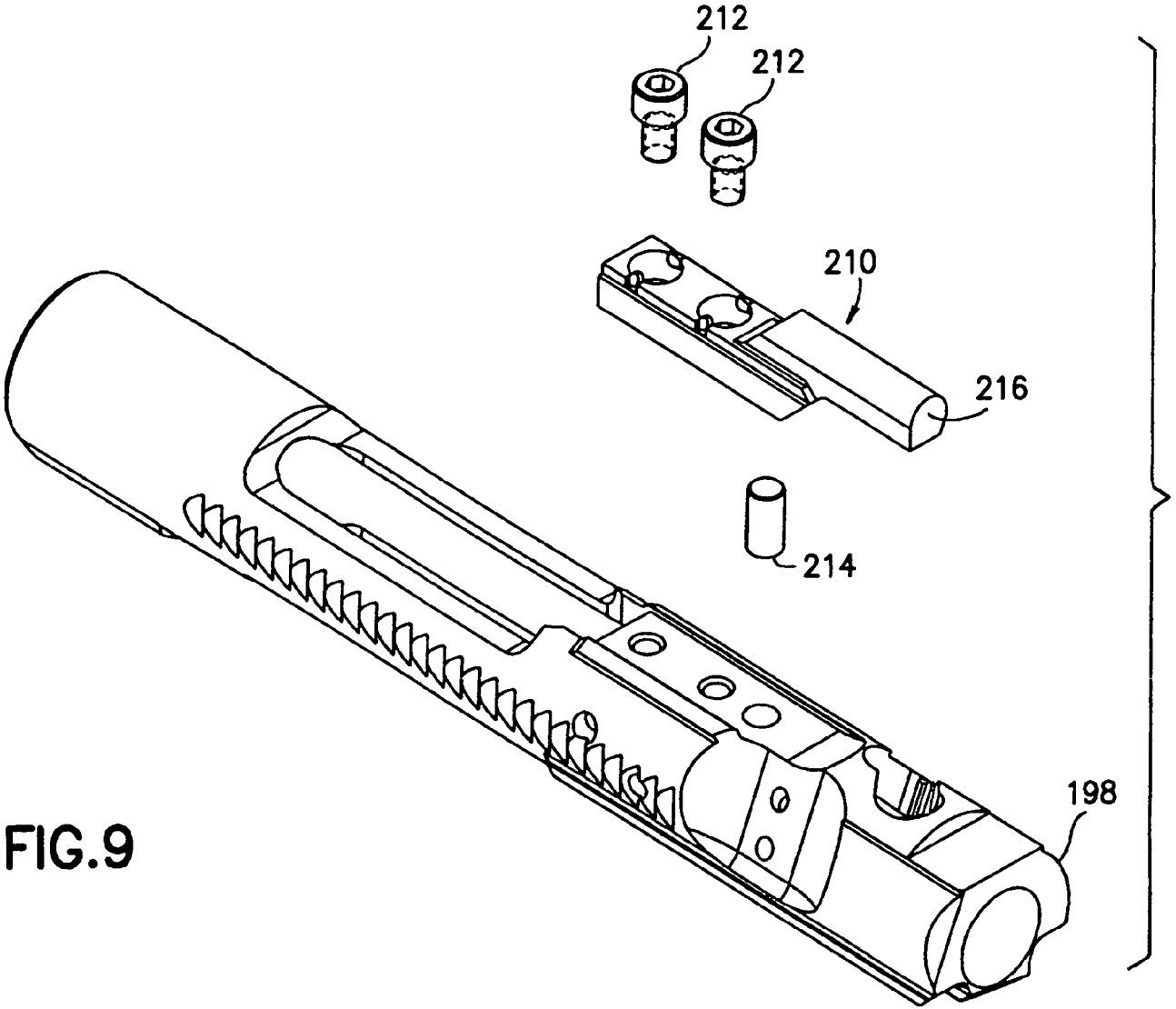
FIG. 9 is an exploded isometric view of a bolt carrier.
Figure 10:
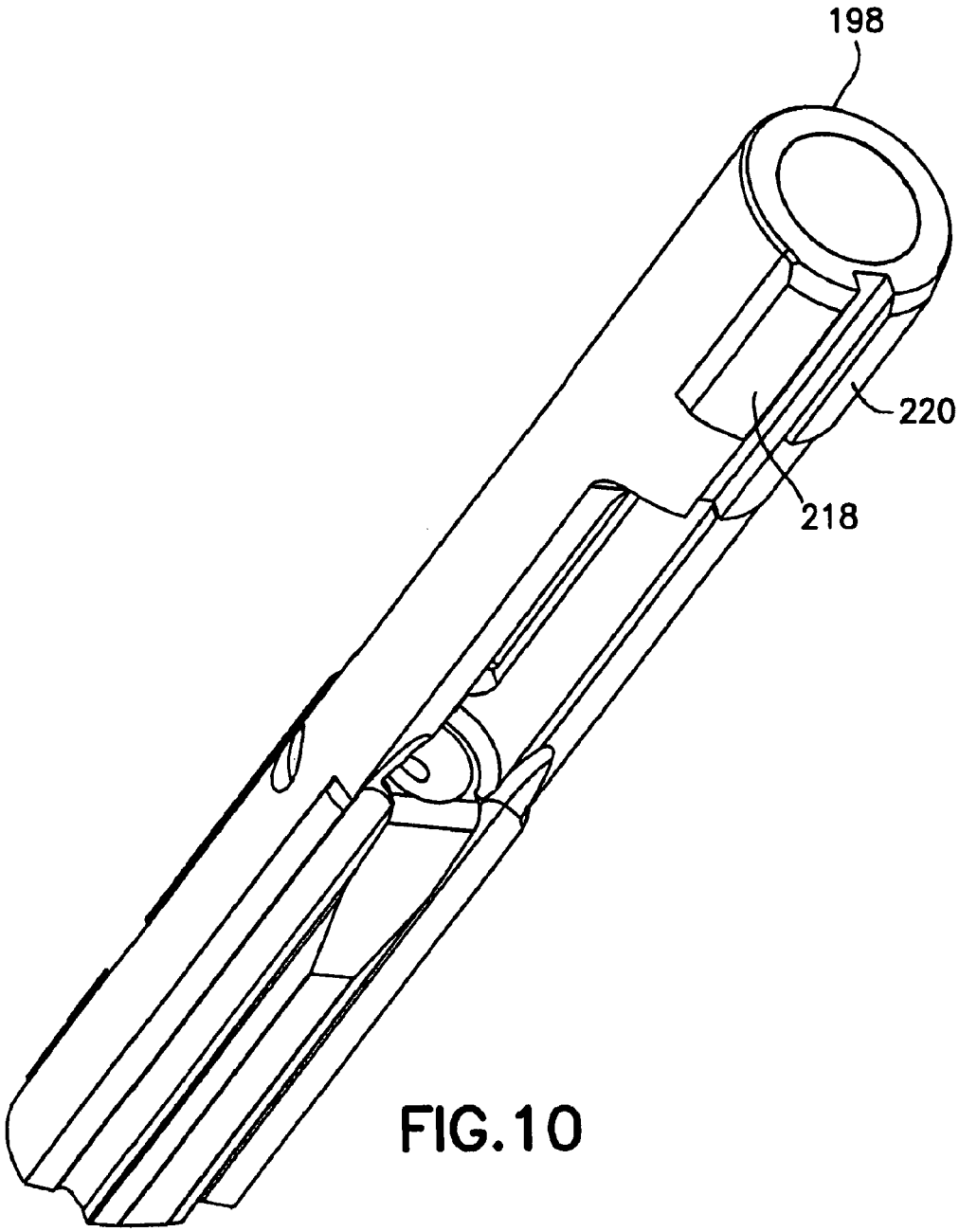
FIG. 10 is an isometric view of a bolt carrier.
Figure 11:
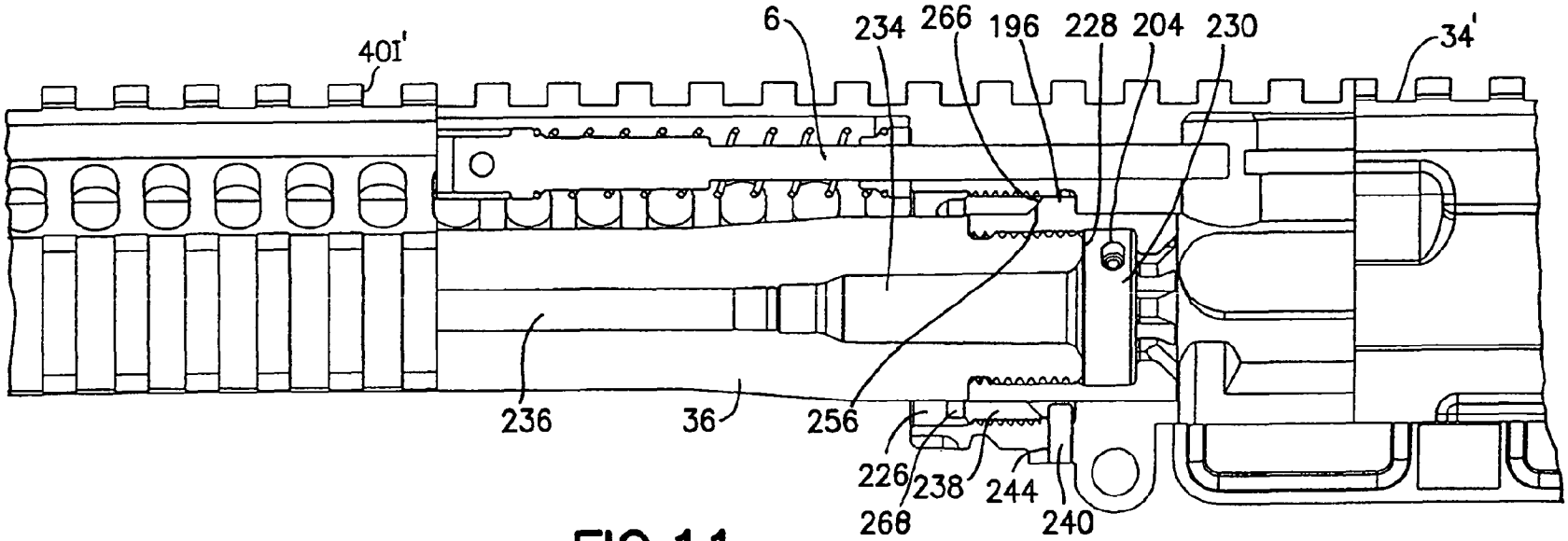
FIGS. 11-11A are respectively a partial section view and partial cut-away isometric view of the receiver and barrel assembly.
Figure 11A:
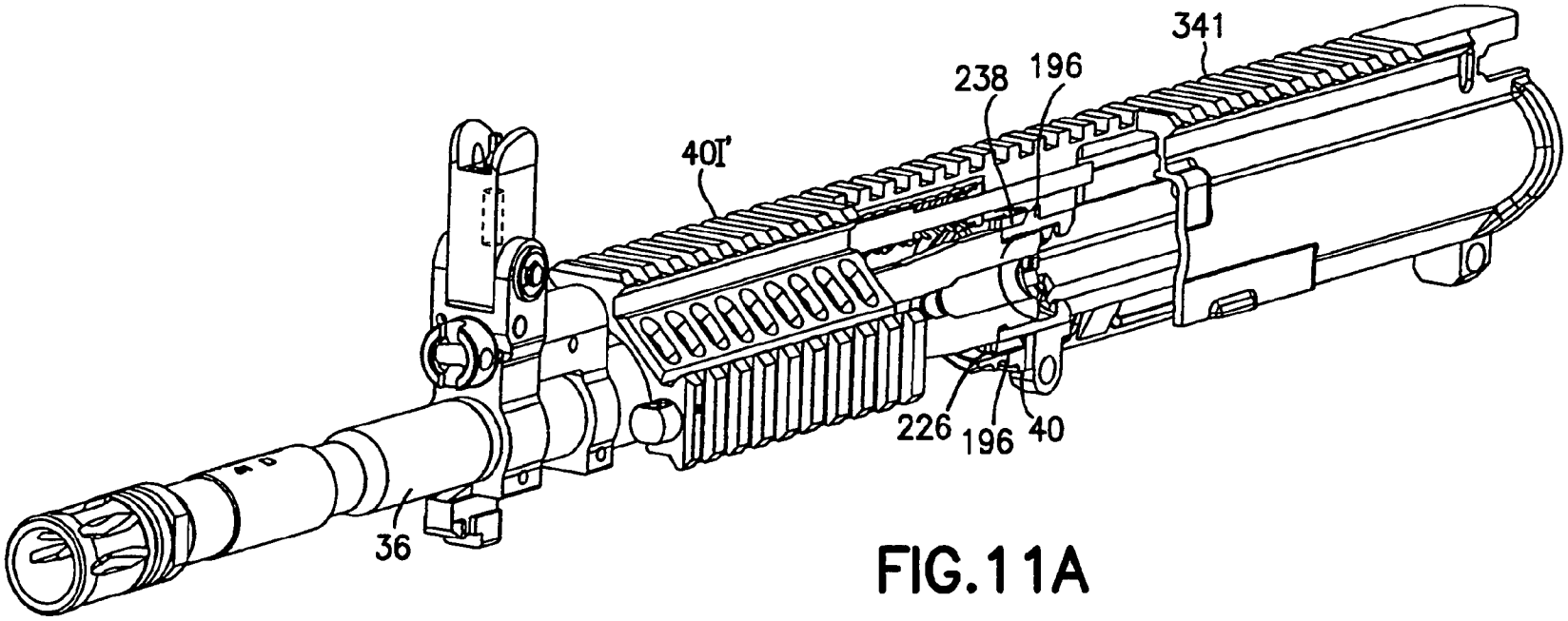
Figure 12:
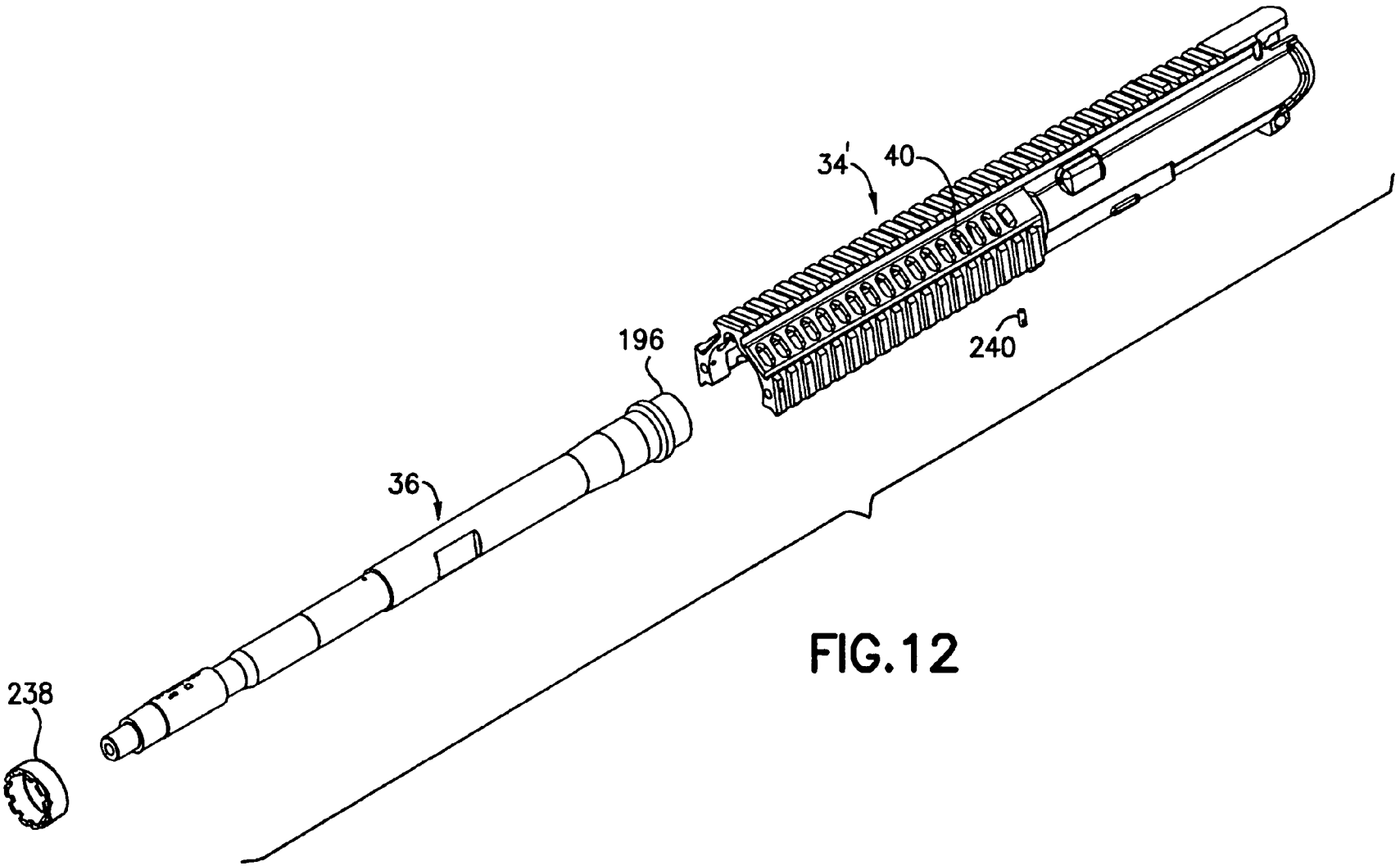
FIG. 12 is an isometric view of barrel assembly.
Figure 13:
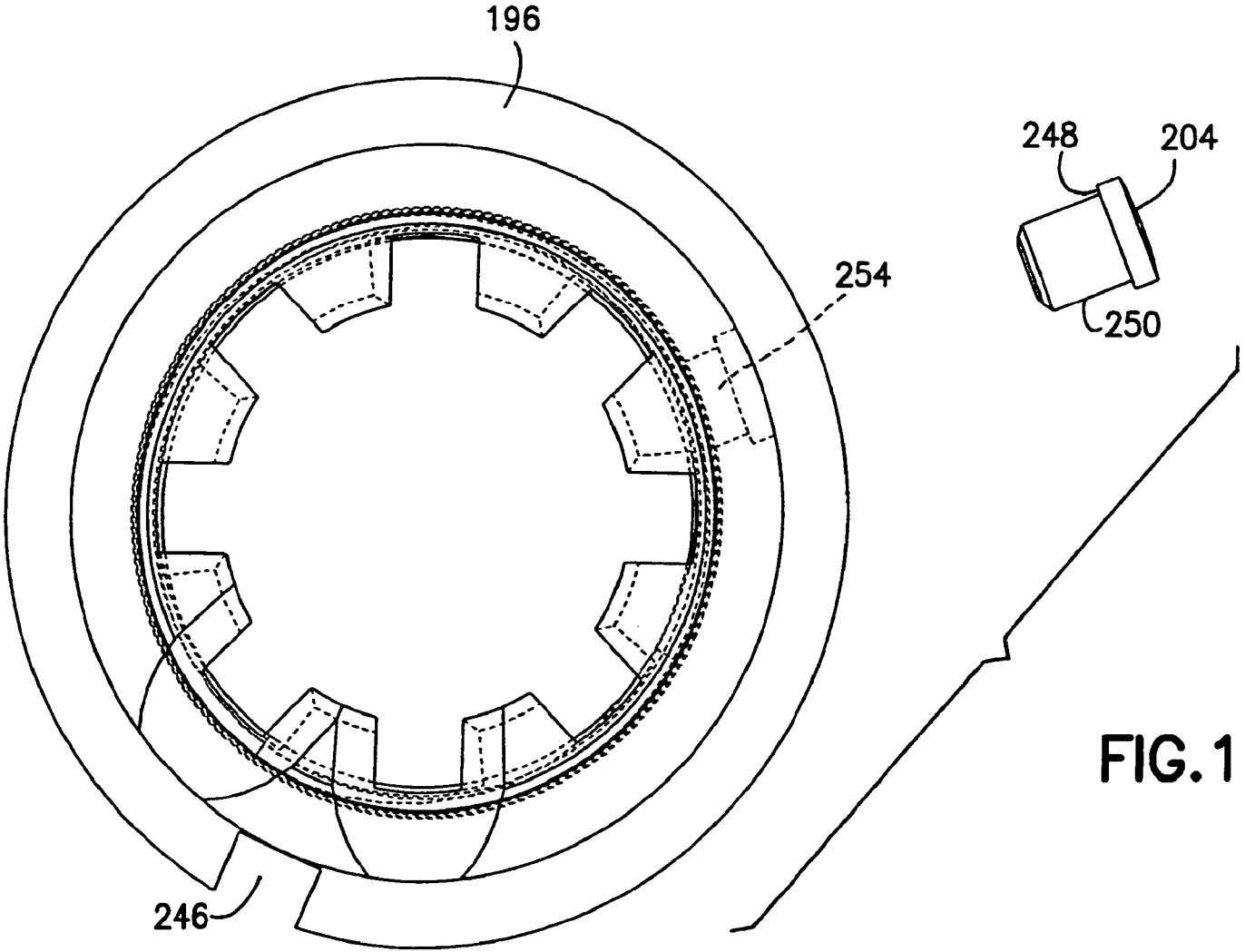
FIG. 13 is an exploded view of a barrel extension.
Figure 14:
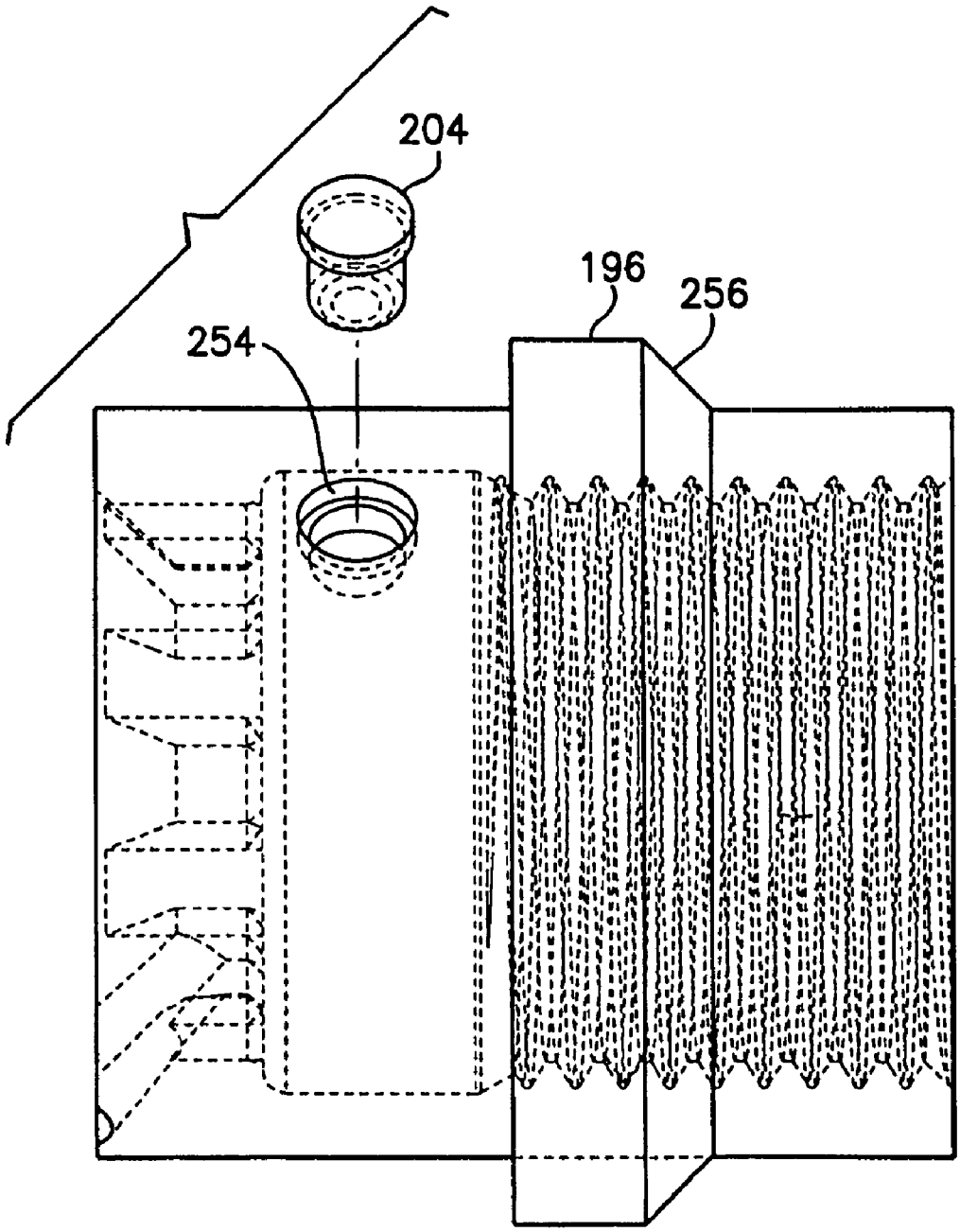
FIG. 14 is an exploded view of a barrel extension.
Figure 15:
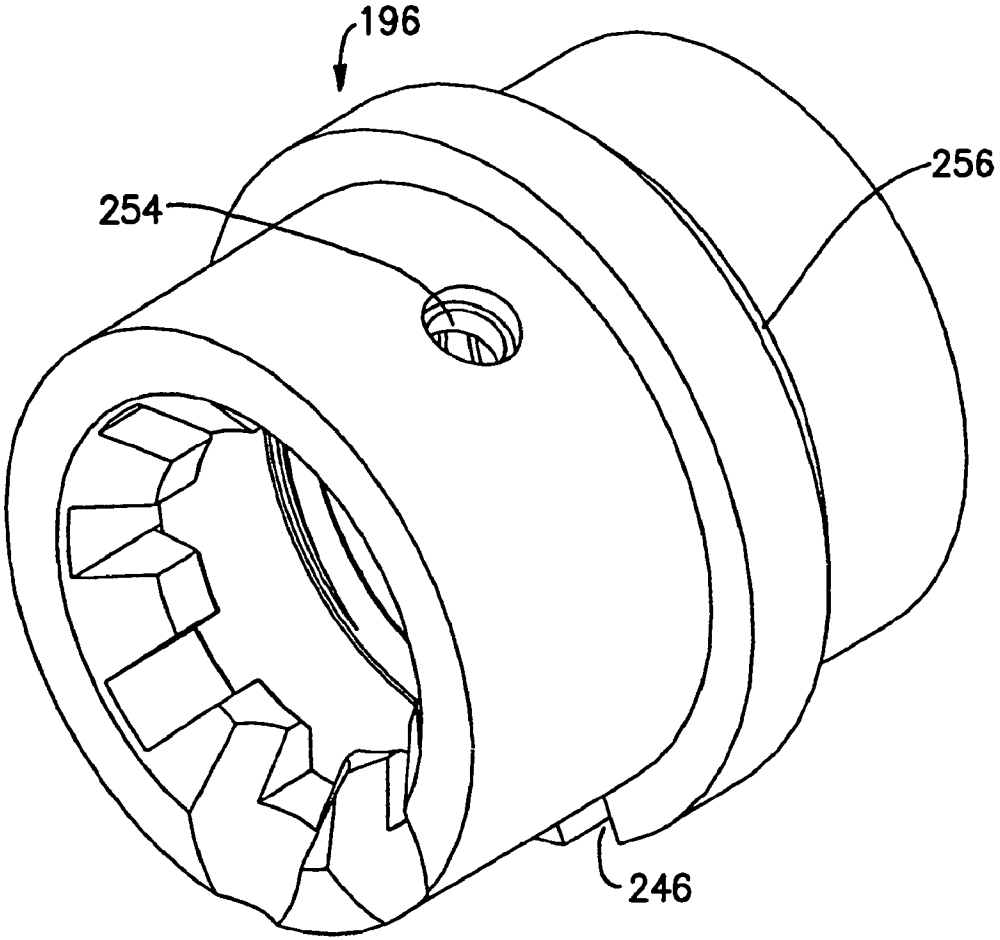
FIG. 15 is an isometric view of a barrel extension.
Figure 16:
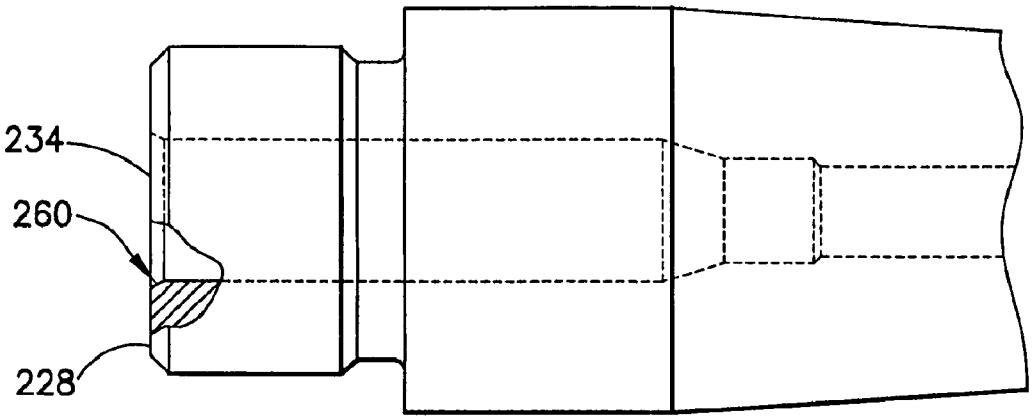
FIG. 16 is a side view of a barrel.
Figure 17:
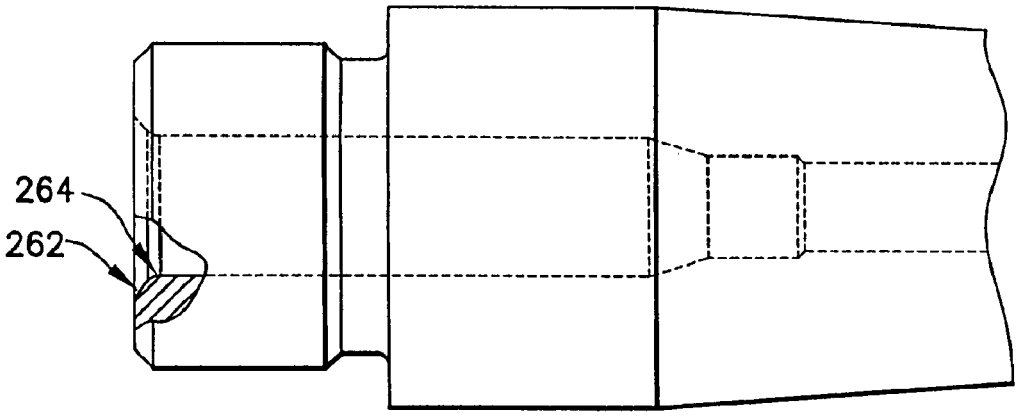
FIG.17 PRIOR ART
FIG. 17 is a side view of a barrel.
Figure 18:
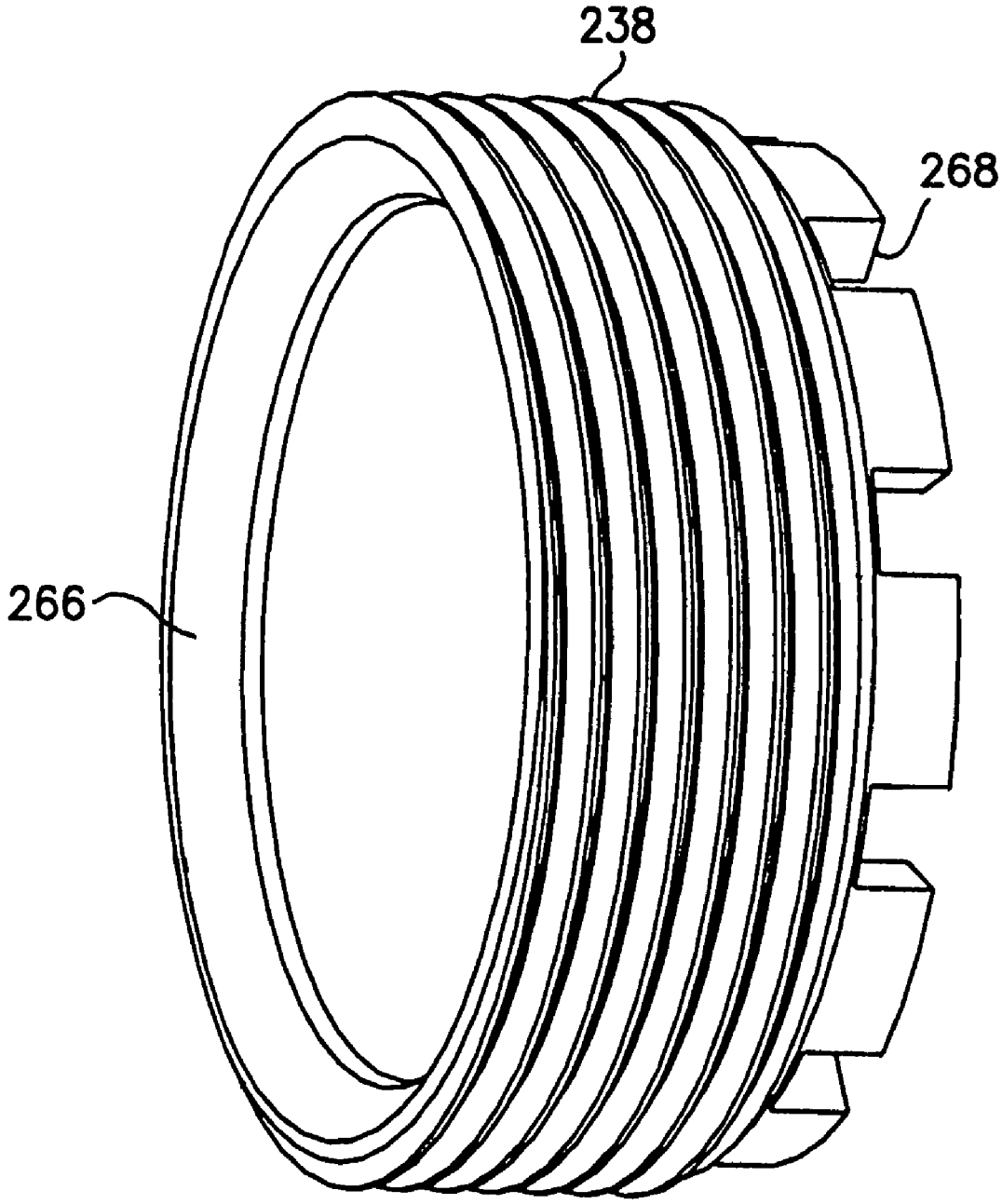
FIG. 18 is an isometric view of a barrel nut.

Referring now to FIG. 6, there is shown a side elevation view of an ejection port cover. Referring also to FIG. 7, there is shown an exploded view of the ejection port cover shown in FIG. 6. On a conventional firearm, for attachment of the ejection port door, a one piece rail may prevent sliding of pin axially due to interference from rails. In the embodiments shown, grooves or slots 182, 184 are formed on bottom of mounting lugs 166, 168. Pin 158 may be provided to slide up into lugs 166, 168. Taps or pin holes 174, 176 may be provided transverse towards the receiver to accept screws or pins 170, 172. Holes 174, 176 may extend through the receiver wall into the receiver inner space. In this manner, access may be provided to push out the pins 170, 172 into the interior of disassembled receiver for removal. Ejection port door 54 may be provided and slides over pin 158. Here, bosses 166, 168 may be provided, slotted on the bottom and pin 158 may be slid in with a cross pin to hold it in place. Spring 164 and detent 156 are provided to maintain the position of door 54 as desired. Referring now to FIG. 8, there is shown a view of a barrel extension and an extractor 200. Referring also to FIG. 9, there is shown an exploded isometric view of a bolt carrier. Referring also to FIG. 10, there is shown another isometric view of the bolt carrier. As may be realized bolt carrier 198 holds a bolt with extractor 200. As seen best in FIG. 8, in this embodiment, barrel extension 196 has extractor locking pin 204 provided having gap 224 between extractor locking pin 204 and extractor 200. Gap 224 is shown with extractor 200 in a position without a cartridge in place. When a cartridge is in place, gap 224 may be reduced, such as to 0.005 inches nominal where extractor 200 flexes to retain the cartridge. As seen best in FIG. 9, in the exemplary embodiment bolt carrier 198 is provided for use with a gas piston or indirect gas operating system, as will be described below, that operates against carrier key 210. In the exemplary embodiment, the key may be a solid key. Pin 214 is provided with two screws 212 to hold carrier key 210 to bolt 198. In alternate embodiments, other attachment methods may be provided. Carrier key has impingement face 216 to interface with the indirect gas operating system's rod. As seen best in FIG. 10, skids 218, 220 are provided on the back of carrier 198. Skids 198, 220 are provided such that when bolt carrier 198 is impacted by the piston of an indirect gas operating system (e.g. impinging the impingement face 216 and hence impinging on the bolt carrier offset from the centerline of bolt carrier 198 and generating an overturning moment causing the back end of bolt carrier 198 to kick down), the skids provide a raised compensating surface on the lower rear portion of bolt carrier 198 to counter the overturning moment and distribute the loading on the bolt carrier 198 thereby allowing the bolt carrier to slide smoothly rearwards towards the receiver extension. Referring now to FIGS. 11-11A, there is shown a respectively partial section view and partial cut away perspective view of an upper receiver 34 and a barrel assembly in accordance with another exemplary embodiment. Referring also to FIG. 12, there is shown an exploded isometric view of the receiver 341 and barrel assembly. Referring also to FIG. 13, there is shown an exploded view of a barrel extension. Referring also to FIG. 14, there is shown an exploded view of the barrel extension. Referring also to FIG. 15, there is shown another isometric view of the barrel extension. Referring also to FIG. 16, there is shown a side view of a barrel. Referring also to FIG. 17, there is shown another side view of the barrel. Referring also to FIG. 18, there is shown an isometric view of a barrel nut.

Receiver 34' is substantially similar to receiver 34 described previously, except as otherwise noted. Similar features are similarly numbered. Receiver 34' is, as shown in FIG. 11A, a one piece member of unitary construction with an integral hand guard 40l'. In the exemplary embodiment shown in FIGS. 11-11A, gas piston system is depicted disposed between barrel and receiver 34 for example purposes. In alternate embodiments, the firearm may have a gas tube in place of the gas piston system. As seen best in FIGS. 11-11A, the receiver 34' has a bore 226 in the barrel. Assembly is received and mated to the receiver as will be further described below. In the exemplary embodiment, barrel assembly generally includes barrel 36, barrel extension 196 and a barrel nut 238. Barrel 36 has bore 236, a breach with cartridge receiving section 234 and bolt interfacing surface 228. The barrel extension 196 is threaded onto barrel 36 with both threads and seating surface for positive location. In alternate embodiments, the barrel extension may be interfaced with the barrel in any other manner. In alternate embodiments, barrel extension 196 may be integrally formed as part of barrel 36. In alternate embodiments, bolt interfacing surface may have a different shape, such as a cone shape or other suitable shape. Barrel extension 196 is placed in bore 226 having a flange that stops against a flange of bore 226. Barrel extension 196 has taper 256 to center and lock barrel extension 196 in position and to increase the clamped surface area. The barrel in combination with barrel extension may be attached to the receiver with barrel nut 238. Barrel nut 238 is provided to clamp and lock barrel 36 into counter bore 226 of the receiver. Barrel 36 attachment is accomplished via taper 256 on barrel extension 196. Barrel nut 238 is threaded on the outside for engaging internal threads in bore 226. Extension flange 268 is provided on barrel nut 238 and provides engagement for wrench (e.g. spanner wrench) inside bore 226 for example, the flange 268 of the barrel nut may be castleated as shown in FIG. 1B. By providing barrel nut 238 as shown, the nut 238 may be removed or installed in the receiver 34' of unitary construction with integral hand guard and without, for example, removing a gas piston operating system or a gas tube. Here, for example, nut 238 has an outer circumference that clears the gas operating system G. Angled interior mating surface 266 (see also FIG. 18) on barrel nut 238 is provided for centering of the barrel 36 via mating clamping and centering surface 256 of barrel extension 196 (see also FIG. 14). The interior of the bore 226 of the receiver 32A is provided with inner threads that engage the outer threaded barrel nut 238. As may realized, the tapered surfaces 256, 266 respectively on the barrel extension and barrel nut provide additional surface area for frictional clamping and cooperate to centralize the barrel due to the matching taper on the nut and barrel. Here, the combination of barrel nut 238, extension 196 and bore 226 provides very effective locking, barrel centering, and eliminates the potential for the barrel to move relative to the receiver as any tolerance related clearances or play between the barrel and receiver are eliminated. In the exemplary embodiment, a locating notch 246 may be provided in barrel extension 196 (see FIGS. 13 and 15) for index pin 240 to positively locate the barrel 36 in the proper orientation. Barrel index pin 240 may be pressed into bore 244 on the bottom of the upper receiver 34' from underneath. In this manner, a stronger interface may be provided, for example, as pin 240 may be longer and softer material and may be less likely to deform metal. As seen in FIGS. 13-14, in the exemplary embodiment, extractor locking pin 204 may be provided, pressed into barrel extension 196. As noted before extractor locking pin 204 acts as a backing surface for extractor 200. In alternate embodiments, any suitable surface may be provided. Extractor locking pin 204 may be provided, for example, on any M-4™ or other suitable firearm. Extractor lock pin 204 is provided in barrel extension 196 and positioned to back up extractor 200. In alternate embodiments, extractor locking pin may be provided on any suitable barrel. Referring also to FIG. 8, extractor 200 may have a typical clearance 224, for example of 0.005". In alternate embodiments, other suitable clearances may be provided. Bullet casing flexure, for example in the event of over pressure due to barrel obstruction, may move back extractor 200 and close gap 224 to abut extractor lock pin 204. In the embodiment shown, pin 204 may be fixed in place and press fit into extension 196.

As will be described further, in the embodiment shown in FIG. 16, a reduced radius 260 may be provided between cartridge receiving section 234 and bolt interfacing surface 228. As may be realized by comparison with the representative conventional barrel shown in FIG. 17, in the exemplary embodiment the cartridge entry ramp or chamfer 262 is eliminated and replaced with entry radius 260 to reduce the unsupported length of a cartridge, This reduces the chance for cartridge failure. As noted before, the extractor locking pin 204 effectively locks extractor 200 in place tending to minimize the chance of failure, for example where the cartridge deflection under pressure would cause extractor 200 to flex excessively resulting in a failed extraction or otherwise. To further mitigate risk of failure, radius surface 260 at the mouth of cartridge receiving section 234 is minimized. Radius 260 is provided off face 228 of barrel 36 on the inside and rolls into chamber 234. Here, radius 260 is interface between the inner surface of the chamber 234 and face 228. Reduced radius 260 provides a shaper corner and provides more support for the casing. In contrast, a conventional cartridge entry ramp 262 having angled or cone 262 and radius 264 as shown in FIG. 17 provides less cartridge support. Radius 260 reduces the empty space and provides additional backing surface for the casing where the casing, in the region where be a weak link reducing the chance of brass failure. The weakest part of the casing is the back area. If the casing fails, it will tend to blow out in the area around the extractor due to lack of support. In the exemplary embodiment the flexure of extractor 200, provided on the bolt (not shown) is snubbed by contact with pin 204. Here, pin 204 supports the extractor 200 prevents casing failure by stopping extractor 200 from excessive flex. Here, the combination of radius 260 and pin 204 significantly reduce the chance of such failure. In this manner, the rear of the cartridge casing that is unsupported is minimized. Radius 260 may have any desired size, for example from 0.030 inches to 0.050 inches and may be polished. In alternate embodiments, radius 260 may be different. In other alternate embodiments, the entry surface may be generally rounded to provide the desired support while ensuring proper feed of the cartridge into the chamber.

Figure 19:
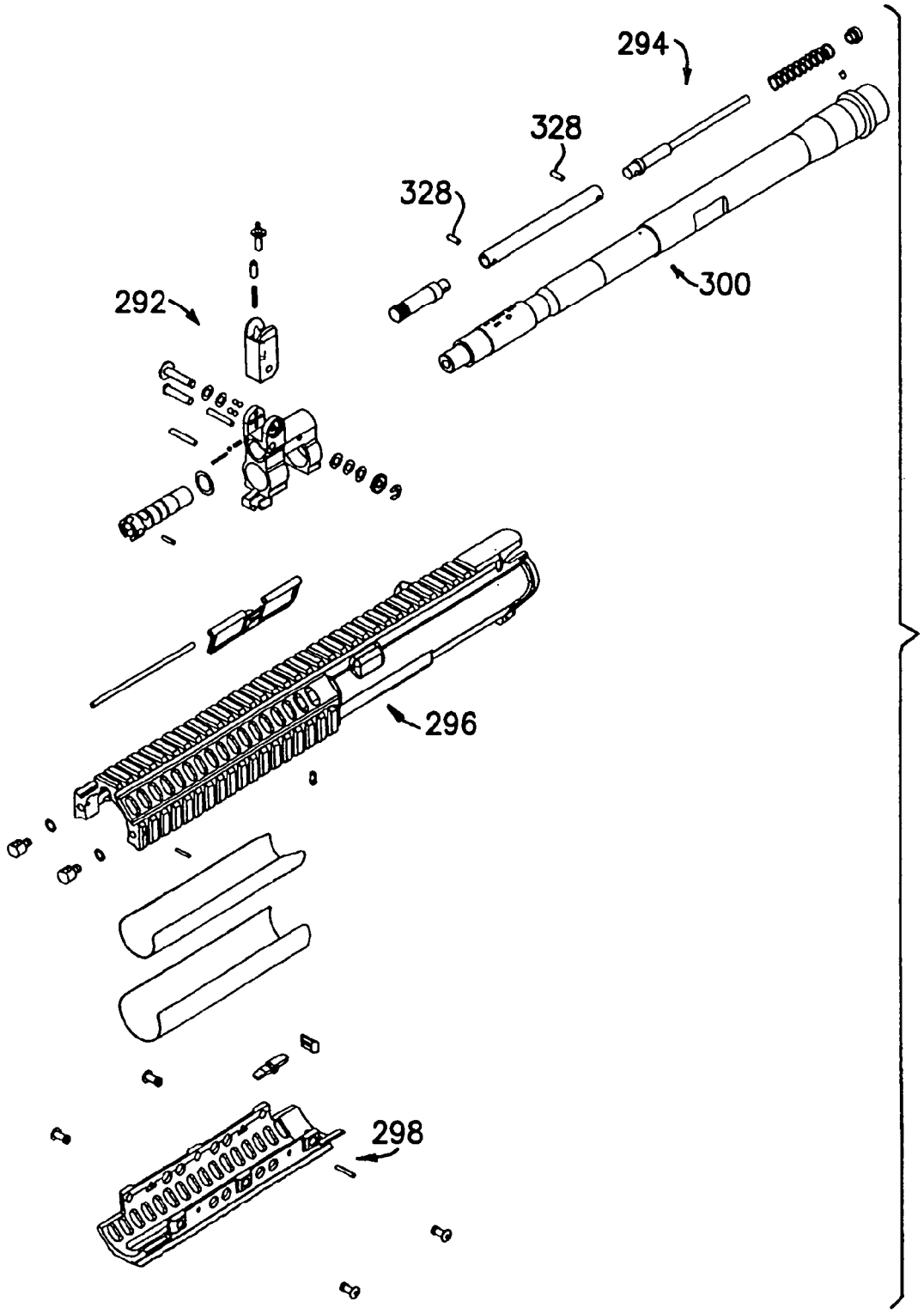
FIG. 19 is an exploded isometric view of a sight and gas piston assembly.
Figure 20:
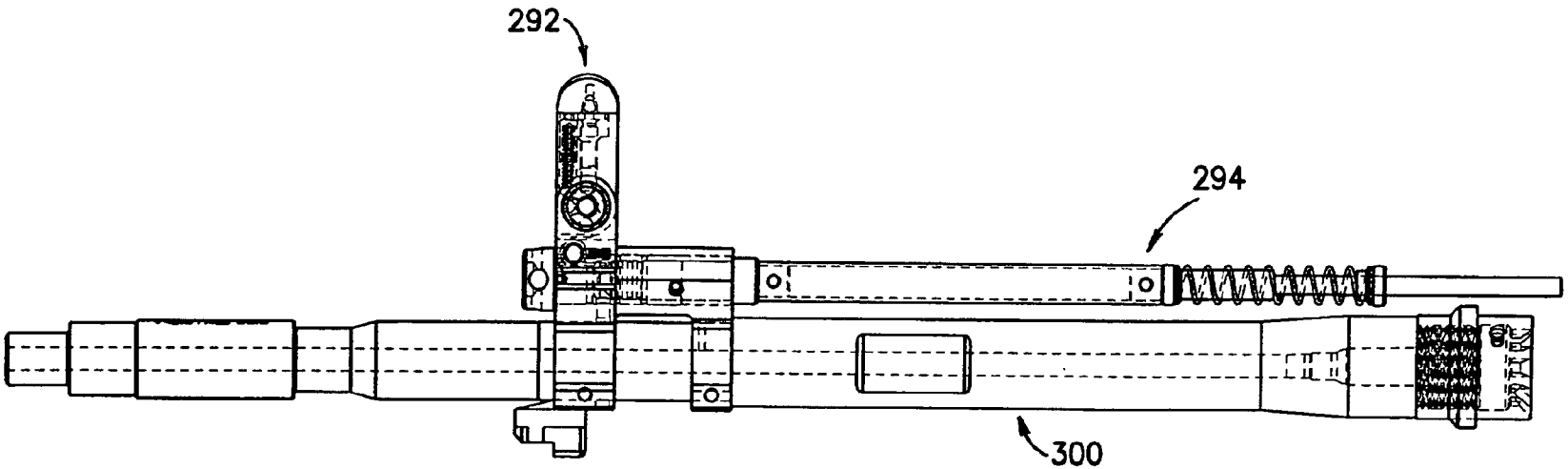
FIG. 20 is a side view of a sight and gas piston assembly.
Figure 21:
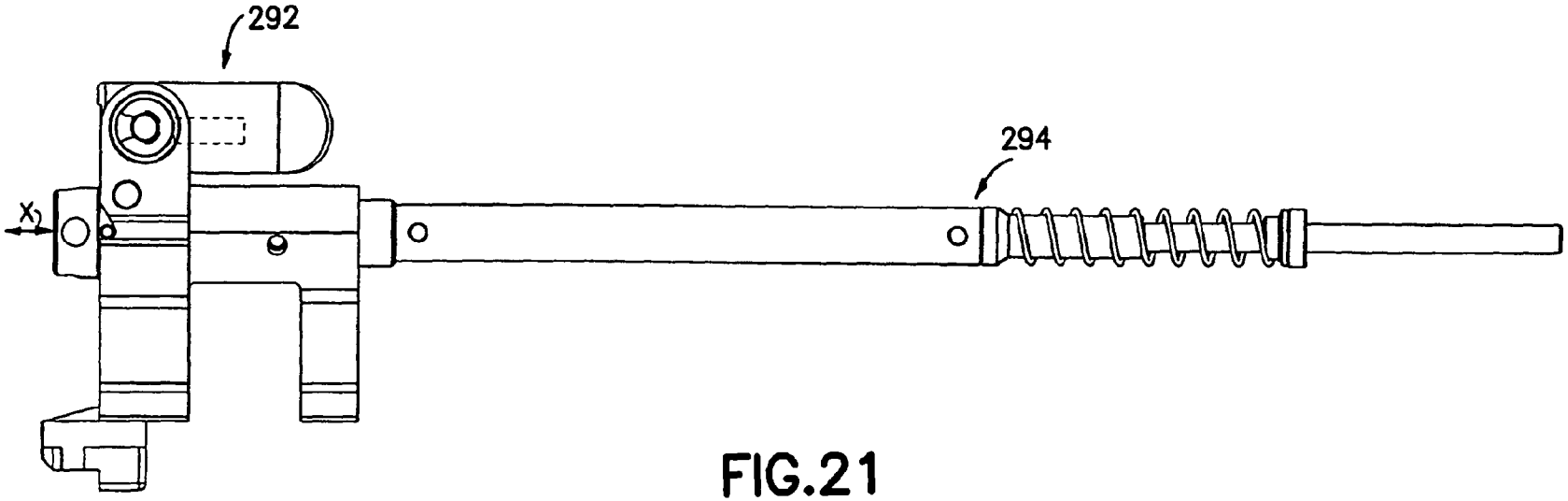
FIG. 21 is a side view of a sight and gas piston assembly.
Figure 22:
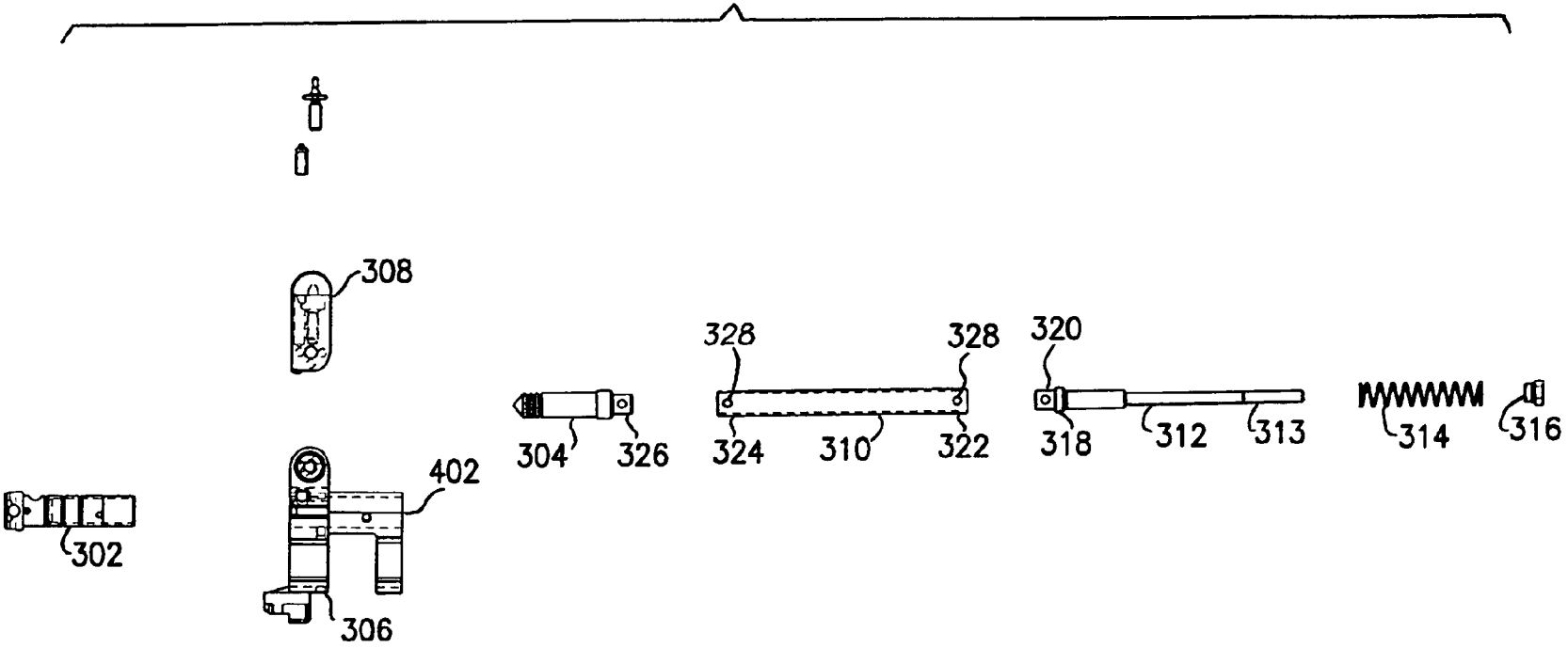
FIG. 22 is an exploded side view of a sight and gas piston assembly.
Figure 23:
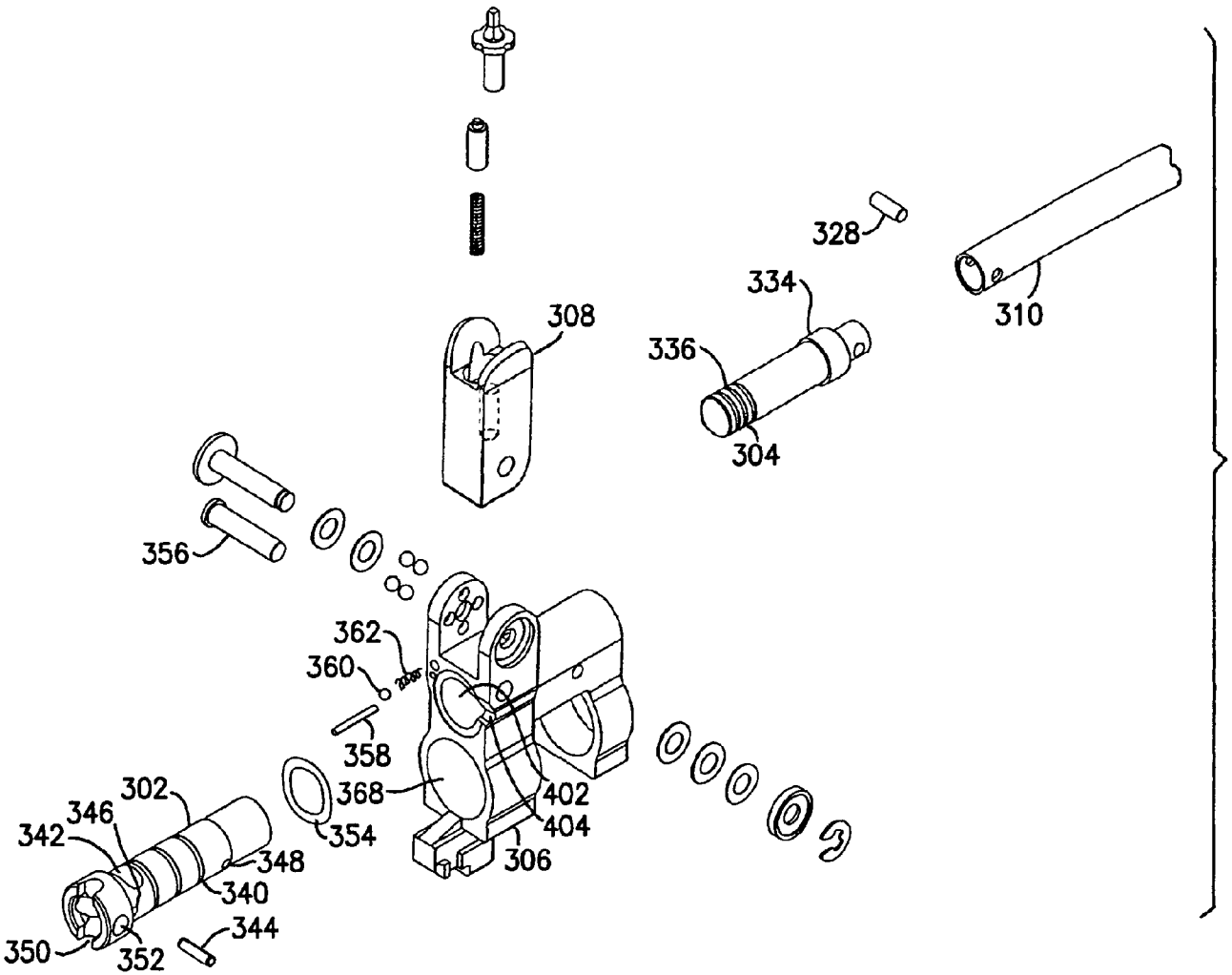
FIG. 23 is an exploded isometric view of a sight and gas piston assembly.
Figure 24:
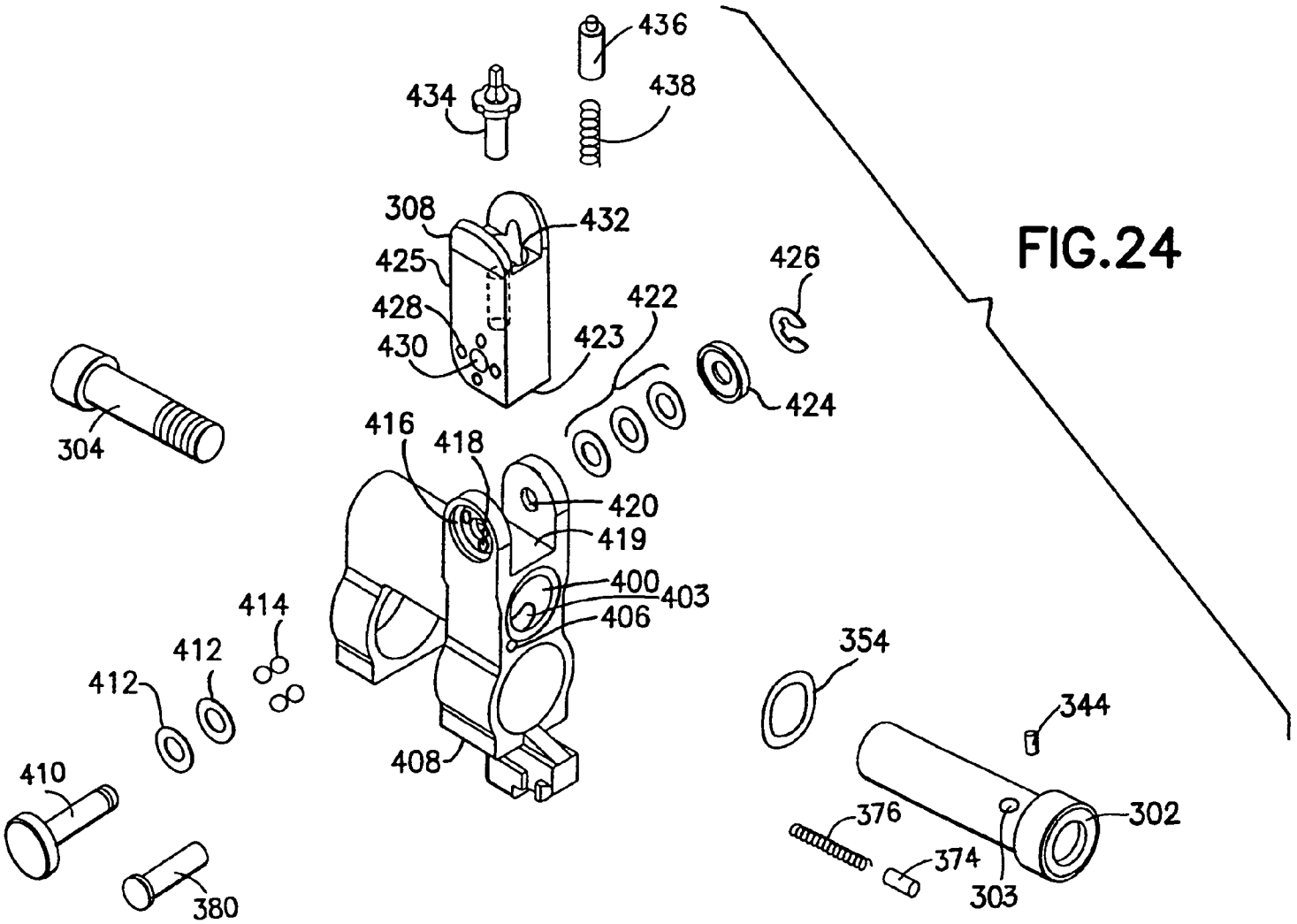
FIG. 24 is an exploded isometric view of a sight and gas piston assembly.

Referring now to FIG. 19, there is shown an exploded isometric view of a sight and gas piston assembly in accordance with another exemplary embodiment. Referring also to FIG. 20, there is shown a side view of a sight 292 and gas piston assembly 294. Referring also to FIG. 21, there is shown a side view of a sight and gas piston assembly. Referring also to FIG. 22, there is shown an exploded side view of a sight and gas piston assembly. Referring also to FIG. 23, there is shown an exploded isometric view of a sight and gas piston assembly. Referring also to FIG. 24, there is shown an exploded isometric view of a sight and gas piston assembly.

Referring again to FIG. 19 there is shown a representative upper receiver assembly 300, gas piston assembly 294, barrel assembly 300, and lower hand guard assembly 298. In the embodiment shown, the receiver is illustrated as being similar to receiver 34 (described before) for example purposes. In alternate embodiments, the receiver may be of any suitable type. In FIG. 20, the sight assembly 292 is shown with the sight in a raised, deployed position. In FIG. 21, the sight assembly 292 is shown with the sight in a lowered, stowed position. Referring now to FIG. 22, there is shown a side exploded view of the gas piston assembly 294 of the firearm. The gas piston assembly 294 is an indirect gas operating system facilitating automatic or semi-automatic operation in place of a conventional direct gas operating system as will be described below. The gas piston assembly 294 may be adjustable, allowing the operator to vary gas pressure as desired. A suitable example of a gas regulator for a gas piston system is described in U.S. patent application Ser. No. 11/231,063, filed Sep. 19, 2005, and incorporated by reference herein in its entirety. As seen in FIGS. 20-22 the firearm has a gas block 306. The gas block 306 may be fitted, for example to the barrel assembly 300, (though any other suitable barrel may be used) the barrel assembly 300 has a bore (not shown), in fluid communication with a gas passage 403 (see FIG. 24) in the gas block. In the exemplary embodiment, the gas piston assembly 294 has a cylinder sleeve piston 304 and a operating rod 312 is housed within the hand guard of the upper receiver. In the exemplary embodiment the gas piston assembly 294 may be installed and removed from the firearm as a unit as will be described further below. The cylinder sleeve is located in a bore 402 in the gas block. The piston 304 is fitted to cylinder 302. Operating rod 312 is joined to the piston and interfaces with bolt carriage assembly 198 provided within the upper receiver (see FIGS. 9-10). The bolt carriage assembly has a impingement surface 216 cooperating with the rod 312 of the operating system. When a cartridge is fired, pressurized gas enters cylinder sleeve 302 in the gas block, displaces piston 304 and causes operating rod 312 to impinge the impingement surface 216 displacing the bolt assembly 198.

Referring again to FIG. 9, the bolt carriage assembly 198 has a bolt carriage frame or carrier and a impinge portion 210. Impinge portion 210 is impinged by operating rod 312 at face or portion 216. Impinge face 216 is located to be substantially coaxial with the operating rod 312. The impinge portion 216 may be suitably shaped (e.g. tapered) to direct loads imparted by rod 312 into the base that engages the impinge portion to the carrier frame. The impinge portion 210 may be press fit, keyed, pinned or otherwise fastened in any desired manner into its corresponding grooves of carrier 198. In alternate embodiments, key ways could be provided within the impinge portion and a corresponding interface on the carrier. In this manner, the bolt assembly may withstand higher impact and operating loads. Referring back to FIGS. 22-24, the cylinder 302 in the gas block has port in fluid communication with the gas block gas passage 403 through an intake or feed disposed on a surface of the cylinder sleeve facing the bore in the gas passage. A piston and rod assembly having a piston 304 and operating rod 312 (housed within hand guard and receiver when mounted to the firearm) cooperate with the cylinder sleeve in the gas block 306. Piston 304 is movably fitted to the cylinder sleeve 302. The operating rod 312 is fixedly joined at its front end, for example by a threaded and/or pinned connection, to piston 304. In the exemplary embodiment, the operating rod may be an assembly with a hollow portion, such as sleeve 310 and a solid end portion, such as rod 312. As may be realized the hollow sleeve, results in a reduction in weight of the operating rod while increasing stiffness. The reduced weight of the operating rod reduces the energy imparted by the operating rod against the bolt carriage, while maintaining equivalent acceleration and hence travel of the bolt carriage when impinged upon the operating rod. In alternate embodiments, other suitable assemblies may be used, for example, where the piston and rod are of two piece or unitary construction. In this embodiment, piston 304 may have a coupling section that couples with sleeve 310, and operating rod 312 has a coupling section 320 that accepts coupling sleeve 310. As seen in FIGS. 22-23, piston 304 and rod 312 each may have a shoulder that mates with sleeve 312. Pins 328 are provided to lock sleeve 310 to piston 304 and rod 312. In alternate embodiments, other engagement techniques could be provided such as threaded coupling. In the embodiment shown, When a cartridge is fired, pressurized gas enters cylinder sleeve 302, displaces piston 304 and causes the operating rod 312 to impinge the impingement surface 216 displacing the bolt carriage assembly. A guide may be provided, for example, to house the operating rod allowing the operating rod to slide freely relative to the receiver. The guide may also have a feature that mates with a mating feature of receiver to correctly position rod relative to the bolt carriage assembly within receiver. The gas piston assembly also includes Spring 314 is provided between the shoulder of rod 312 and stop washer 316 to bias the rod 312 toward the cylinder sleeve 302 where stop washer 316 abuts the receiver. As may be realized, the operating rod and piston comprises a multi piece operating rod in order to reduce the cost of manufacturing and also reduce weight. For example, sleeve 320 may be made from standard tubing with reduced tolerance. Additionally, components may be heat treated. In the exemplary embodiment the sleeve may connect the piston 304 to end portion of rod 312 with threaded connections, and pins 328 keep the threaded connections from disengaging. A groove 313 may be provided for a snap ring on operating rod 312. After assembly of spring 314 and/or stop 316, the snap ring may be added capturing the spring 314. In this manner, when the piston and operating rod assembly is removed, the assembly, including the spring and retaining components is removed also without further disassembly of the firearm. The spring 314 may also serve as a retention member for stop washer 316 during removal and insertion of the gas piston assembly. For example the end coils of the spring may be positively engaged with the piston and stop washer. For example, the piston and stop washer may each be provided with a channel or groove for interlocking with end coils of the spring. In this embodiment, a snap ring would not be used to retain spring and stop washer on the operating rod.

Referring still to FIGS. 23 and 24, the gas piston assembly 294 incorporates a quick removable cylinder sleeve 302. The sleeve may be removable from the front of gas block 306 and therefore removable from the front of the receiver or rail. This further enables removal of the gas piston assembly from the firearm as a unit. In the exemplary embodiment removable cylinder sleeve 302 is maintained captive with takedown pin 356 above cylinder sleeve 302 engaging slot 342. Pin slot 342 in the upper portion of cylinder 302 provides a cam surface for pin 356 to cam gas cylinder sleeve 302 to seal gas cylinder 302 opening to gas port in sight block 306. Wave spring 354 is provided under the head of cylinder sleeve 302 to bias cylinder 302 forward, removing play and actuating the cam surface 342 by lock pin 356. The take down pin may be held captive, for example, by the spring 362 and detent ball 360, or pin 358, for example. Indexing pin 344 is provided for aligning purposes, aligning cylinder sleeve 302 in proper angular orientation relative to gas block 306. Index pin 344 rests against cam surface 404. Cam surface 404 cams the cylinder sleeve 302 outwards. In the exemplary embodiment cam surface 404 is angled so that rotation of the cylinder sleeve (for example, counterclockwise) bears the pin 344 against can surface 404 forcing cylinder sleeve 302 out of bore 402. In the exemplary embodiment, external annular groove(s) 340 are provided on cylinder 302 for cutting carbon buildup in gas block bore 402 housing cylinder sleeve 302 where the gas sleeve is the actual cylinder outer surface. Gas ports 303, 403 (see FIG. 24) may be provided respectively in the cylinder sleeve 302 and the gas block 306, for example gas intake port(s) to the cylinder sleeve. The cylinder sleeve 302 may also have exhaust ports 348. he annular grooves 340 in the outside diameter of cylinder sleeve 302 facilitate cutting gum or carbon that may have impacted on the inside and act as a scrapper and may also be relieved in the back to clear any carbon buildup. Referring still to FIGS. 23 and 24, front sight assembly 292 generally comprises base section 408, front sight post 308 and a spring loaded pivot or detent assembly. Front sight support 308 is mounted to base 408 with sight pivot pin 410. Sight post 434 is threaded into sight support 308 and may be vertically adjustable by rotation and locked with detent 436 spring loaded by spring 438. Front sight 292 comprises a raisable sight with a folding construction allowing a user to position the sight in a raised position shown or to rotate the sight to a lowered stowed position. Spring loaded detent balls lock the sight 308 in the raised, upper or stowed, lowered positions. Holes 428 are provided in sight piece 308. Holes 418 are provided in sight mount 408. Holes 418 house balls 414 where balls 414 are preloaded against sight 308 via Bellville washers 412 backed by Sight pivot pin 410. Pivot pin 410 is retained in bores 420, 430 with washers or Bellville washers 422 and retaining ring 424. Holes 418 and 428 are provided with intentional misalignment between the holes or pockets 428 and holes 418 housing balls 414 to allow the sight to be preloaded against stop surface 419 where the balls 414 do not fully seat in pockets 428. Here, the detent bias' sight step 423, 425 onto flat 419 of sight frame depending on whether the sight is in the raised or lowered position. In alternate embodiments, any suitable stop surfaces or features may be used. Here, sight 308 is provided with bottom locating step 423 preloaded against surface 419 due to the preloaded balls being misaligned with holes 428, resulting in a rotational moment being applied to the sight. Here, the detent bias' and tends to lock the sight forward against a positive stop 419. Here the detent balls being spring loaded creates the bias. In alternate embodiments, more or less balls may be provided or alternate detent mechanisms may be provided to preload the sight against a stop feature. Spring loaded balls 414 are engaged by bellville washers 412 or, for example, by a combination Bellville and flat washer to engage in a locked position providing a detent that engages sight 308 and locks sight 308 in down and up positions. Here, when sight 308 is in the up position, sight 308 is biased forward. Here, surface 423 may be provided with a pad on that bias in position and locks down against so that sight 308 always repeats in the raised position where the raised position is positively located as opposed to relying solely on the positioning of the detent alone where play may be present. Here, the sight is preloaded against a positive stop without any play. Here, four dimples 428 may be provided rotated and misaligned, for example by one degree relative to the poles 418 in the sight 308 when in a desired position, for example, the raised position. This misalignment causes balls 414 to contact a side of holes 428 and opposing sides of holes 418, forcing site 308 forward and against surface 419 where surface 423 is preloaded against the forward portion of surface 419. Similarly, when in the lowered position, misalignment may cause balls 414 to contact a side of holes 428 and opposing sides of holes 418, forcing site 308 rearward and against the rearward portion of surface 419 where surface 425 is preloaded against surface 419. Here, the bias is provided due to the preloaded balls acting on the side of the holes resulting in the sight being maintained in a vertical orientation. In alternate embodiments, more or less balls or holes may be provided in alternate positions. In the embodiment shown, the bias is provided by misalignments of the holes, for example, where the holes 428 in sight 308 are offset by one degree relative to holes 418. In alternate embodiments other offsets or misalignment may be provided to obtain the desired detent. Here, the site 308 has holes 428 rotated counterclockwise relative to holes 418 as shown in FIG. 24 developing a bias onto the forward portion of surface 419 and rotating the sight forward. Similarly, when in the lowered position, the rotation is opposite biasing sight 308 against the rearward portion of surface 419 in the stowed, lowered position.

Figure 25:
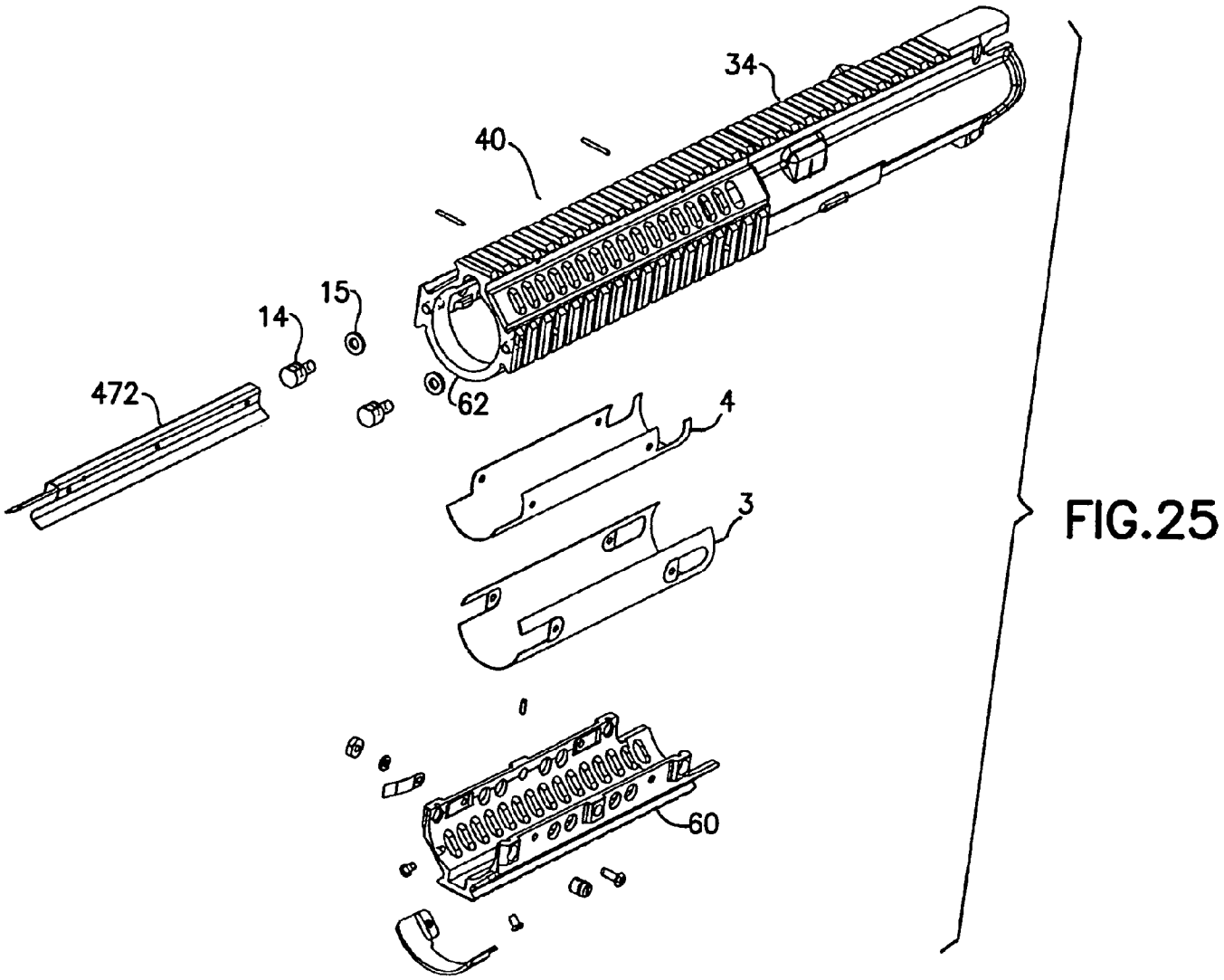
FIG. 25 is an exploded isometric view of an upper receiver assembly.
Figure 26:
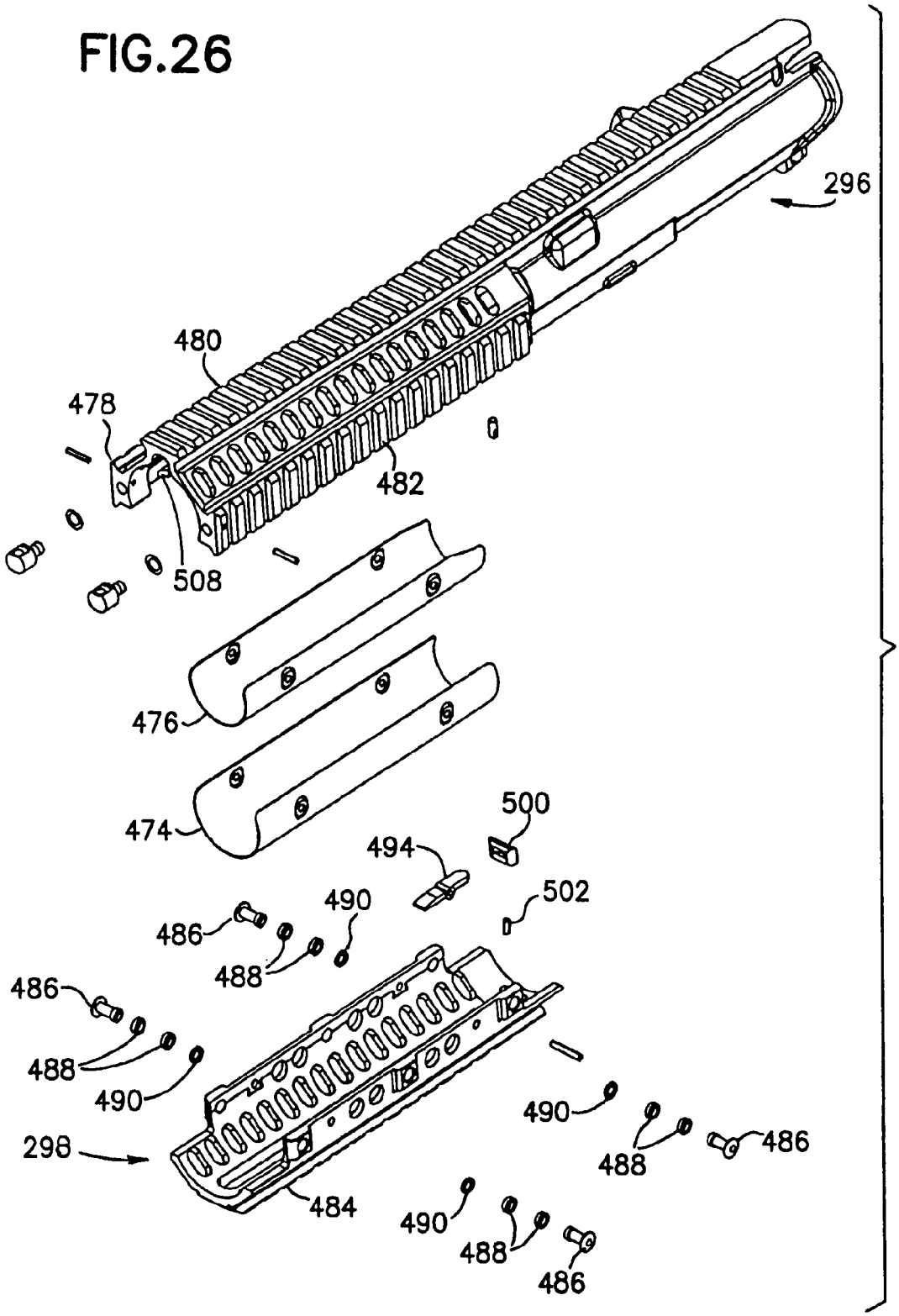
FIG. 26 is an exploded isometric view of an upper receiver assembly.
Figure 27:
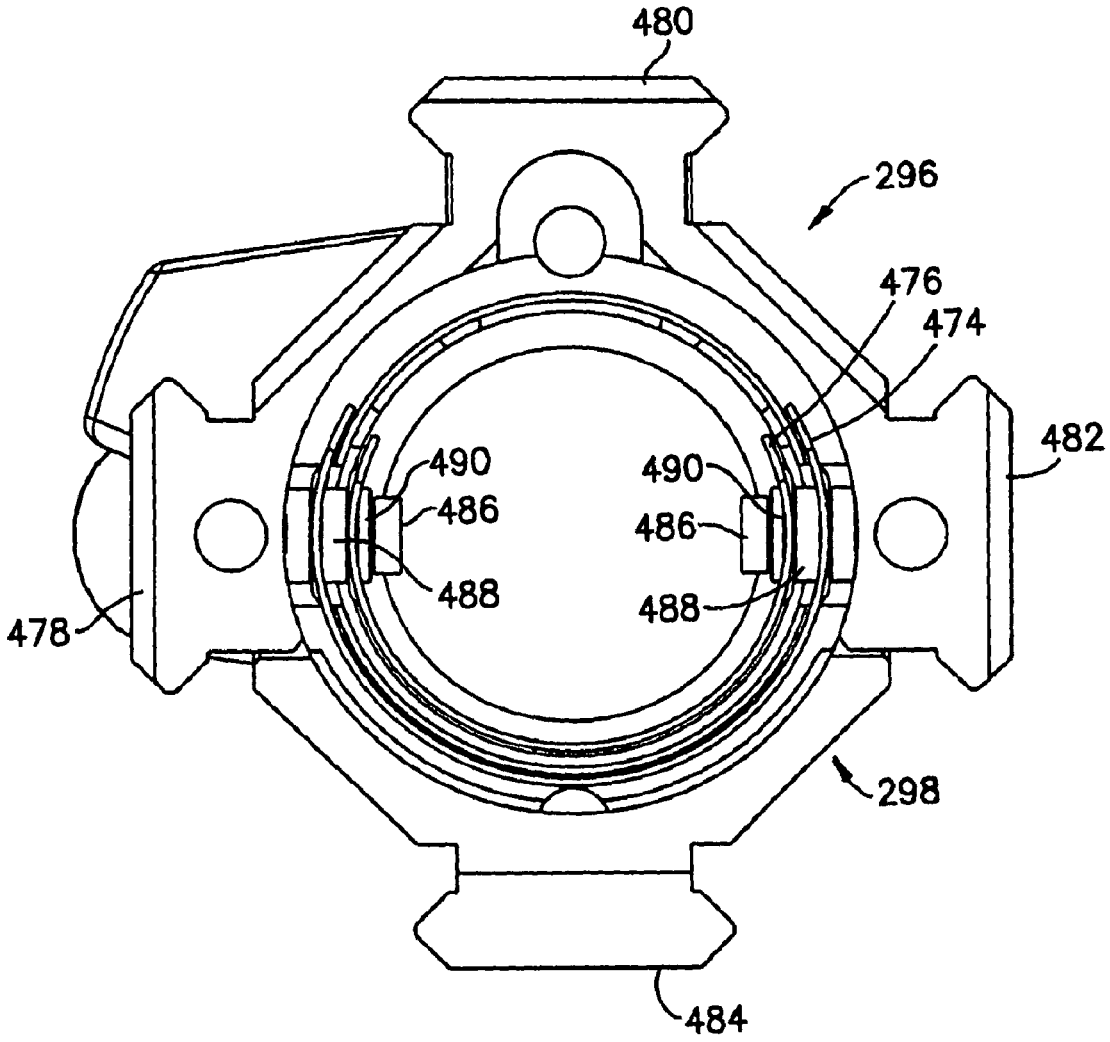
FIG. 27 is an end view of an upper receiver assembly.
Figure 28:
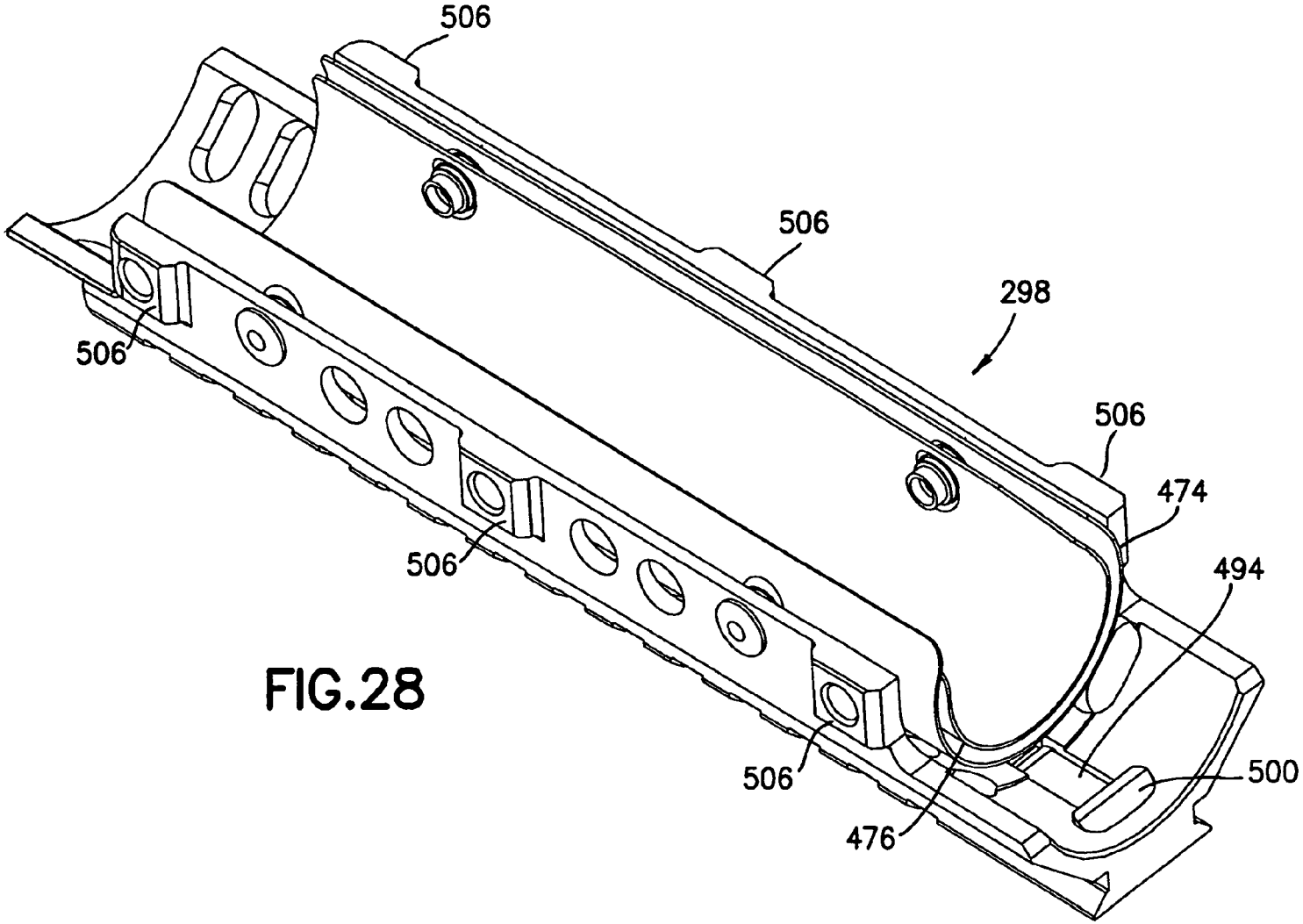
FIG. 28 is an isometric view of a removable hand guard.
Figure 29:
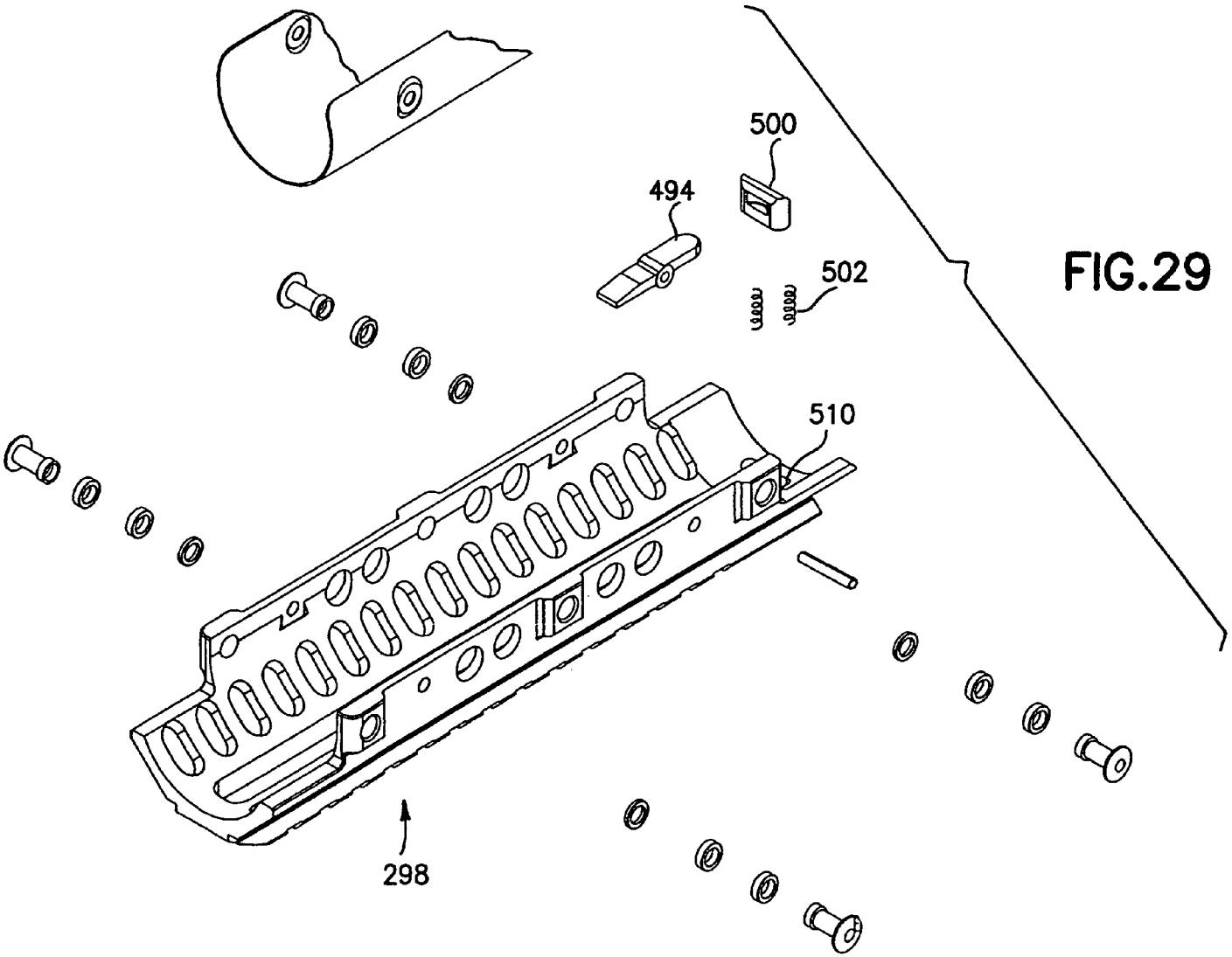
FIG. 29 is an exploded isometric view of the removable hand guard shown in FIG. 28.
Figure 30:
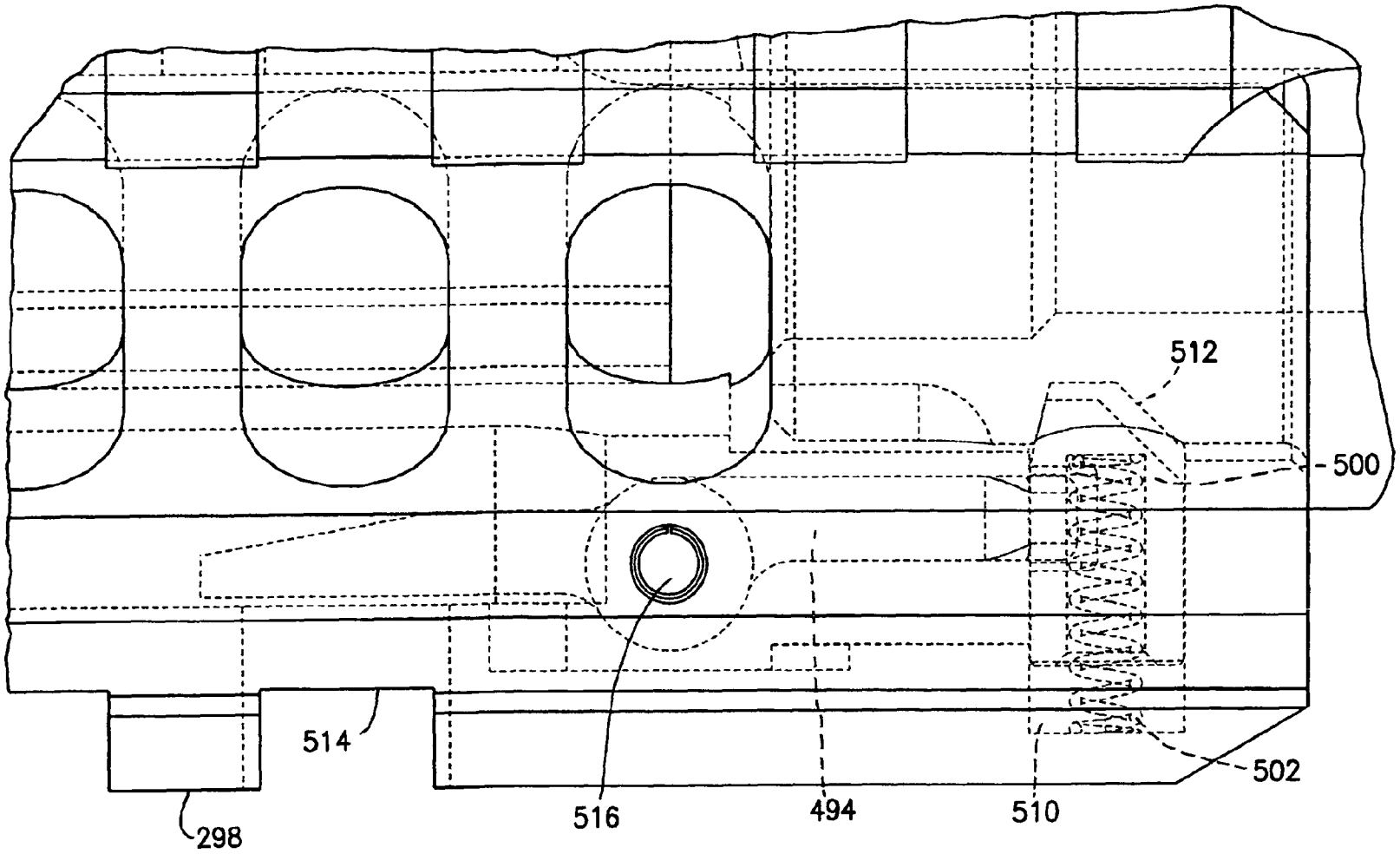
FIG. 30 is a side view of the removable hand guard shown in FIG. 28.
Figure 31:
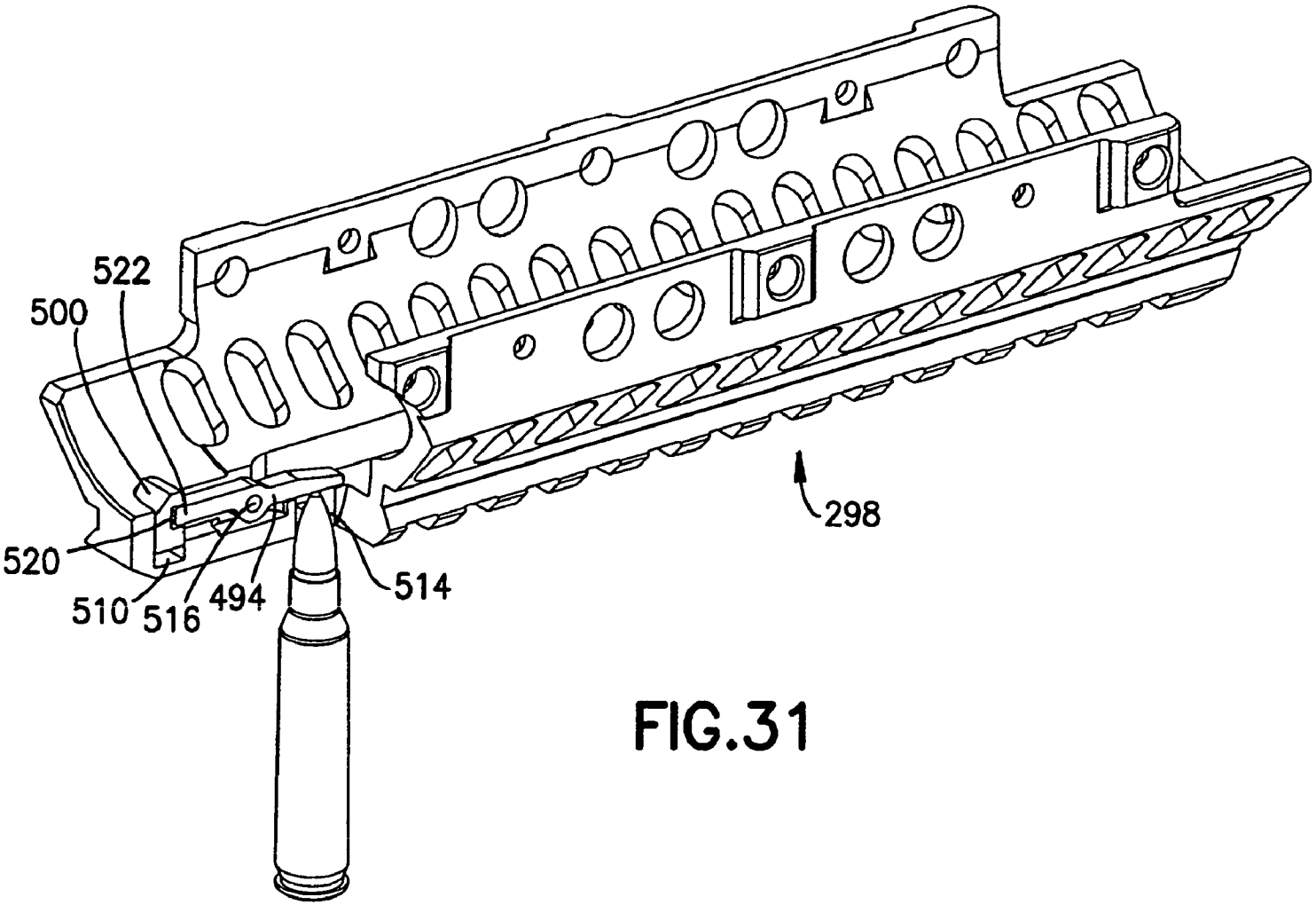
FIG. 31 is an isometric section view of the removable hand guard shown in FIG. 28.

Referring now to FIG. 25, there is shown an exploded isometric view of the upper receiver 34 having hand guard portion 40. Hand guard 40 has removable lower portion 60 having heat shields 3, 4 to facilitate cooling of the barrel 36 while keeping hand guard 40 at a temperature sufficiently low for an operator. Guide and/or shield 472 may be provided for further cooling or as a guide for piston assembly 294. The removable bottom portion 60 having an integral rail is mounted using a keyed/key way system or tongue and groove system. Heat shield(s) may also be secured to the upper portion 40 using any suitable attachment means such as pins, rivets. The bottom portion 60 may be removably attached to the upper hand guard 40 with spring loaded quick release lock(s) that facilitate ease of removal and reattachment of the bottom and upper hand guard portions. In alternate embodiments, other mating and locking features could be provided to couple lower portion 60 to upper portion 40. Support ring 62 is provided at the front of the receiver assembly 34 for strength and attachment purposes. Support or strengthening ring 62 of the upper portion of the hand guard 40 provides a more stable assembly to facilitate manufacture as well as provides a section for the attachment of additional alternate attachments such as by using mounting features 14 to couple attachments, such as a shoulder strap to ring 62. Hand guard 40 may have features such as disclosed in U.S. Pat. Nos. 4,663,875 and 4,536,982, both of which are hereby incorporated by reference herein in their entirety. Hand guard and receiver section may be configured as shown or otherwise to support such rails as a "Piccatiny Rail" configuration as described in Military Standard 1913, which is hereby incorporated by reference herein in its entirety. The rails may be made from any suitable material such as hard coat anodized aluminum as an example. Hand guard 40 may have a forced air cooling system as will be described. For example, radial air grooves may be provided on barrel 36 that extend through the receiver section. The air grooves are part of the forced air cooling system that utilizes the motion of the bolt and bolt carriage assembly to pump cool air along the barrel and through hand guard assembly which houses a radiator element that surrounds a reduced diameter portion of the barrel. Here, air may be forced from the receiver by the bolt assembly, through the barrel retaining nut via grooves into and around the radiator and out cooling holes or slots in the hand guard. In alternate embodiments, the cooling system may be employed on alternate firearm types. Here a one piece monolithic upper receiver is provided having a removable bottom portion 60 of the hand guard where the portion 60 may also have an integral rail, for example, a Pickattiny rail. Here, the bottom portion and rail may be removed to install other accessories, for example, a grenade launcher. Here, the rails on three sides of receiver 34 are fixed at nine o'clock, twelve o'clock and three o'clock with the bottom six o'clock being removable, for example, to allow for mounting of additional accessories. In alternate embodiments. The lower six o'clock rail may be attached by other suitable methods, for example, by latch, rotary latch, push pin, wedge block, front latch or otherwise. For example, a front latch may engage support ring 62. Referring now to FIG. 26, there is shown an exploded isometric view of an upper receiver assembly. Referring also to FIG. 27, there is shown an end view of an upper receiver assembly. Referring also to FIG. 28, there is shown an isometric view of a removable hand guard. Referring also to FIG. 29, there is shown an exploded isometric view of the removable hand guard shown in FIG. 28. Referring also to FIG. 30, there is shown a side view of the removable hand guard shown in FIG. 28. Referring also to FIG. 31, there is shown an isometric section view of the removable hand guard shown in FIG. 28. Upper receiver with hand guard 296 is shown as a monolithic receiver without a support ring. In alternate embodiments, upper receiver 296 may be provided with our without a support ring. Upper receiver 296 is provided with rails on three sides fixed at the nine o'clock 478, twelve o'clock 480 and three o'clock 482 positions with the bottom six o'clock rail 484 being removable as part of lower portion 98, for example, to allow for mounting of additional accessories. As shown in FIG. 27, heat shields 476, 474 may be provided with attachment rivets 480, shield spacers 488 and backing washer 490. In alternate embodiments, other suitable shields or attachment methods may be provided. Lower hand guard section 298 is provided with a quick release lock having a spring loaded latch 500 that fits into and locks up into a recess on the inside of the underneath of the one piece upper receiver 296, for example, into a groove. Referring also to FIG. 31, a latch actuation lever 494 is pivotally mounted on pin 516 to lower portion 298. Actuation lever 494 has tongue portion 522 engaging slot 520 of latch member 500. Latch member 500 is spring loaded upward with springs 502 and engaged in pocket 510 of lower portion 298. Latch actuator lever 494 is provided accessible from underneath, for example, with the point of a suitable and readily available object, such as a cartridge, through an opening 514 in the lower portion 298. As can be seen in FIG. 31, the single action of pushing the lever 494 up effects lowering and releasing latch 500 from a corresponding slot 512 (see FIG. 30) in receiver 296 thereby simultaneously unlocking the removable hand guard from the receiver so that the hand guard is free to move. Here, a single latch 500 is provided cooperating with a lock tongue 506 and groove 508 that slide together. Lock tongue 506 and groove 508 cooperate with latch 500 to accept and retain lower portion 298 to receiver 296. Here, the six o'clock rail 298 goes up into the groove 508 and goes back where the detent 500 snaps into a groove on the upper receiver 296 locking lower portion 298 in place.

Figure 32:
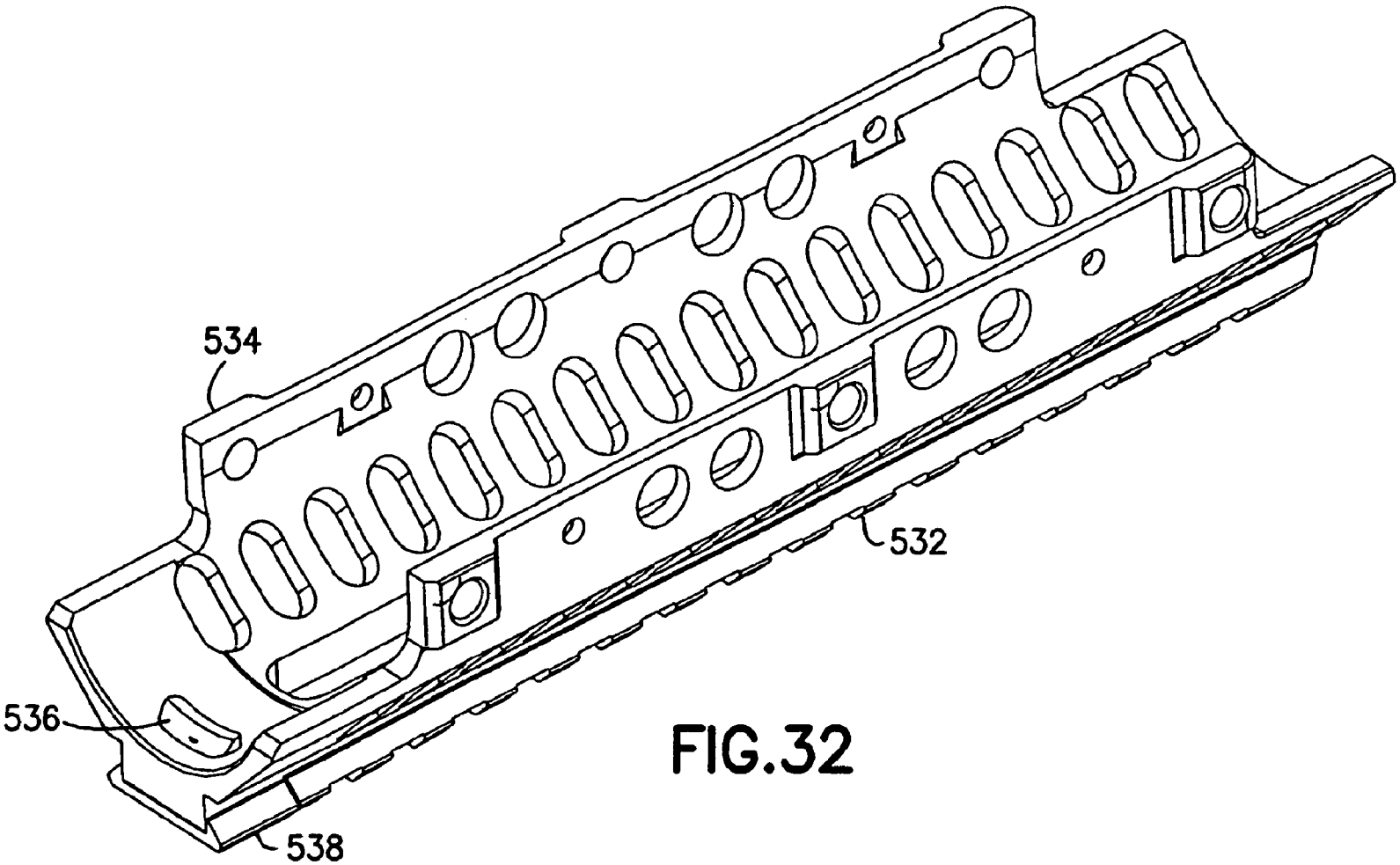
FIG. 32 is an isometric view of a removable hand guard.
Figure 33:
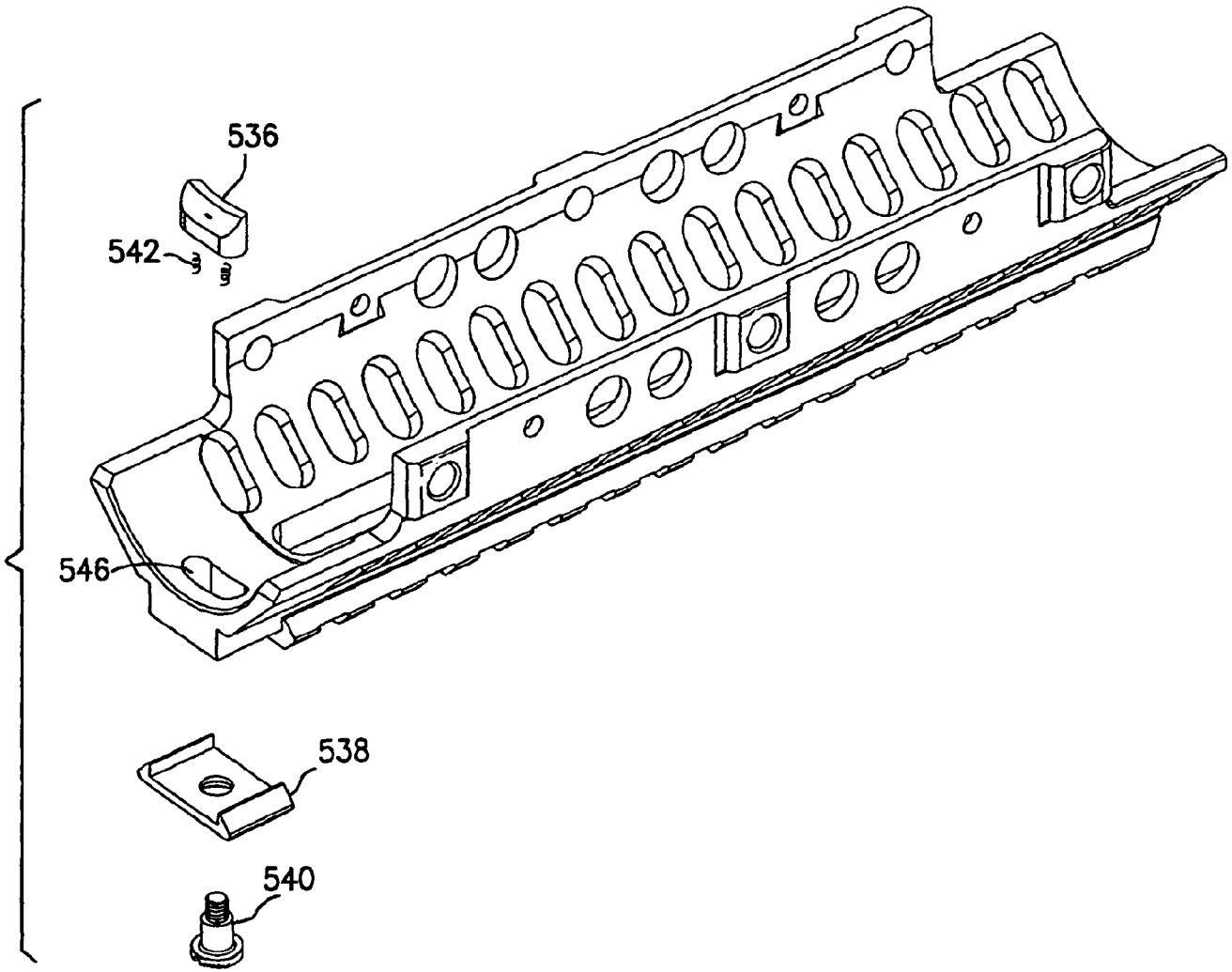
FIG. 33 is an exploded isometric view of the removable hand guard shown in FIG. 32.

Referring now to FIG. 32, there is shown an isometric view of an alternate embodiment removable hand guard 532. Referring also to FIG. 33, there is shown an exploded isometric view of the removable hand guard shown in FIG. 32. The embodiment shown is similar in operation to lower portion 296 of FIG. 26, however employing a quick release lock having a pull button to move the latch between engaged and disengaged positions. Here, latch member 536 is provided, for example to engage with a mating recess in a front ring or at a portion of an upper receiver similar to that shown in FIG. 30. Tongues 534 are provided for mating with corresponding grooves of an upper receiver (not shown). In this embodiment latch 536 may be positioned in slot 546 of lower hand guard portion 532 and threadably engaged to button 540. The latch 536 may be spring loaded by springs 542 biased between latch and hand guard in the slot 546. The latch 536 is released by pulling down the rail extension 538 compressing springs 542.

Figure 34:
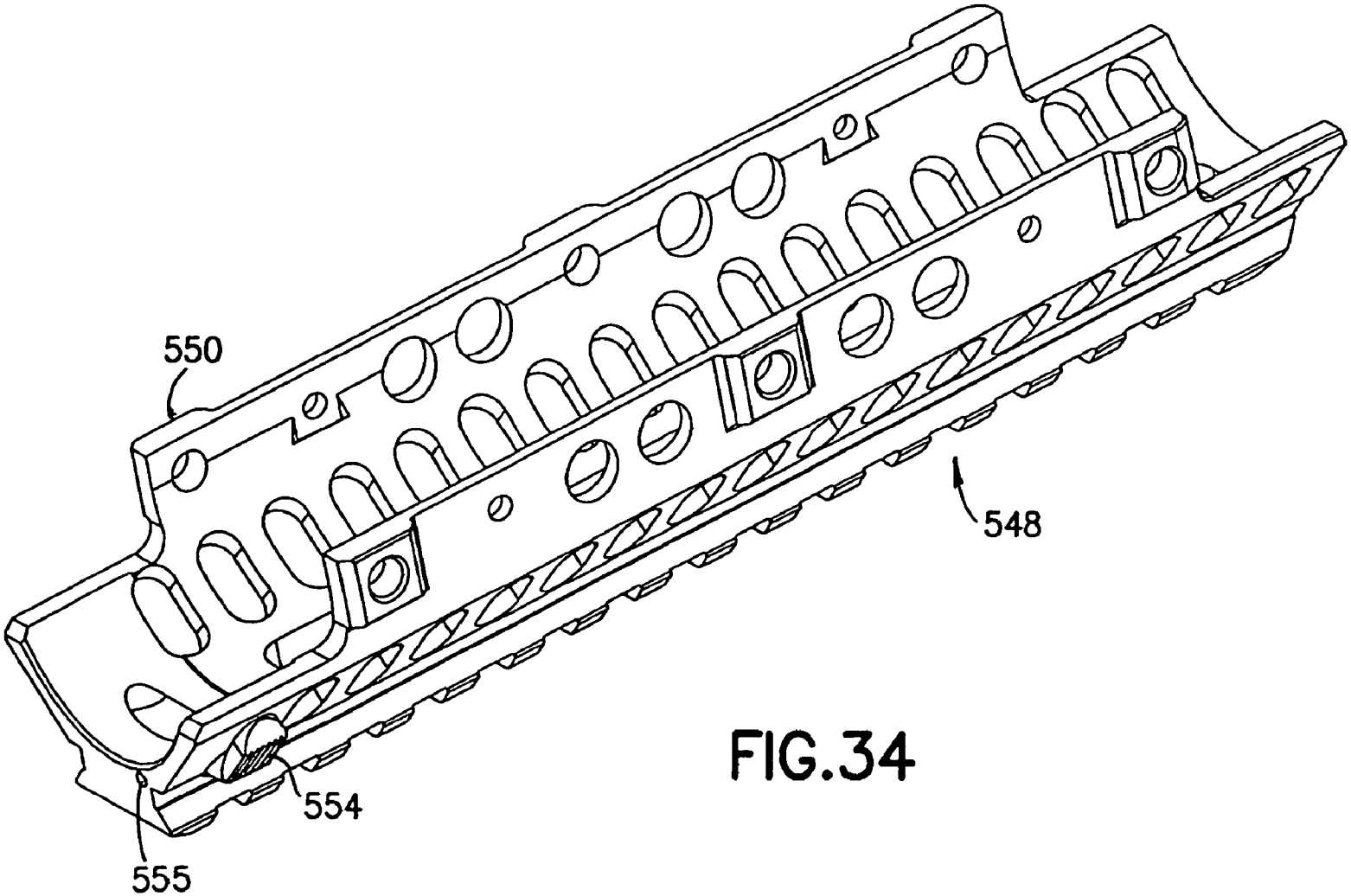
FIG. 34 is an isometric view of a removable hand guard.
Figure 35:
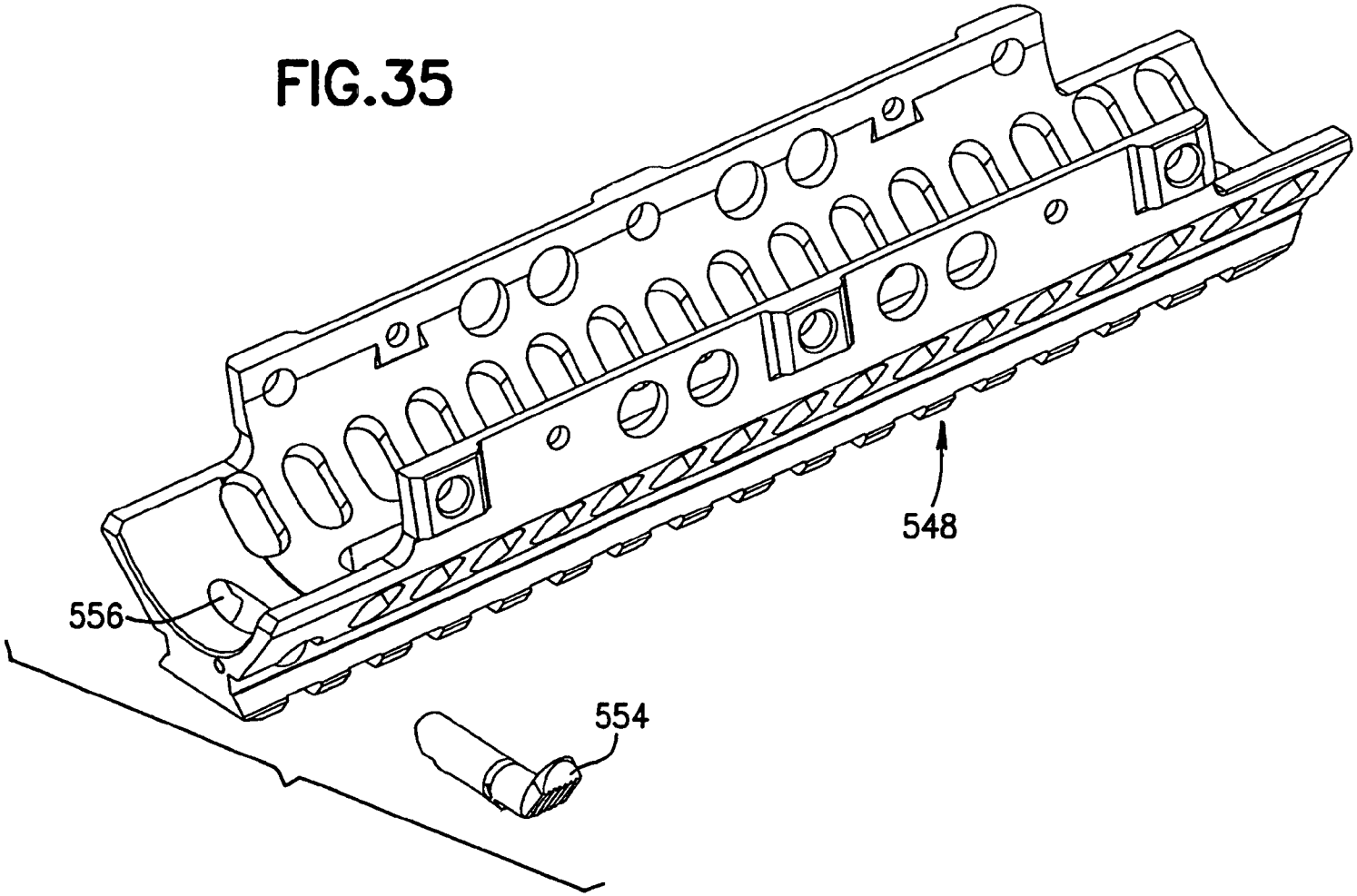
FIG. 35 is an exploded isometric view of the removable hand guard shown in FIG. 34.

Referring now to FIG. 34, there is shown an isometric view of an alternate embodiment removable hand guard 548. Referring also to FIG. 35, there is shown an exploded isometric view of the removable hand guard shown in FIG. 34. The embodiment shown is similar in operation to lower portion 296 of FIG. 26, however employing a quick release lock having a pull pin type latch. Here, latch member 554 is provided, for example to engage with a mating recess in a front ring or at a mid portion of an upper receiver similar to that shown in FIG. 30. Tongues 550 are provided for mating with corresponding grooves of an upper receiver (not shown). Latch 554 is provided within bore 556 of lower portion 548. Here, latch 554 is retained in bore 556 by a spring loaded detent 555. Latch 554 may be released by pulling the pin outward from bore 556 to disengage mating recess in the receiver to allow removal of lower portion 548. The pull latch 554 may be provided, for example on the front of lower portion 548 and engaging a support ring.

Figure 36:
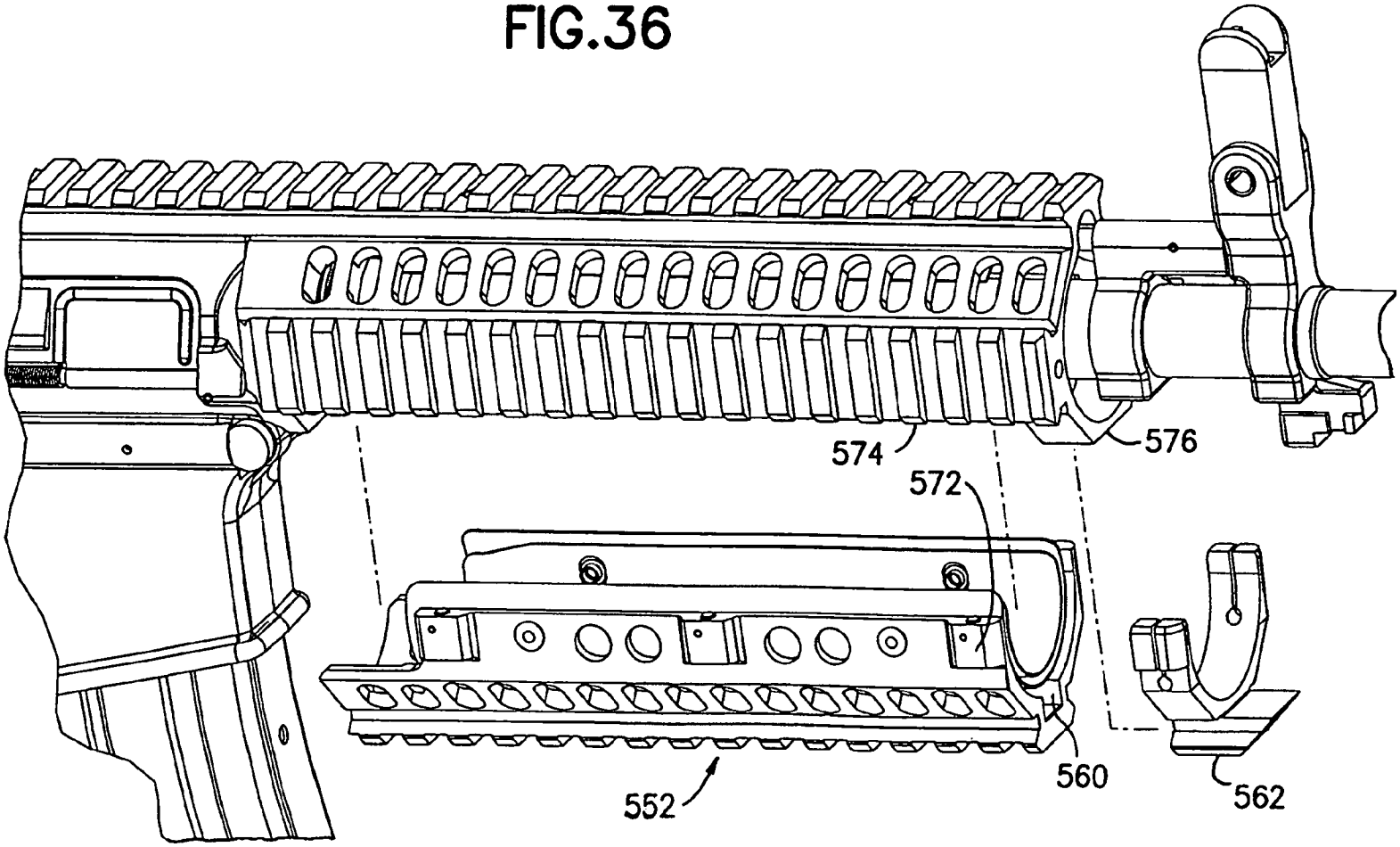
FIG. 36 is an exploded isometric view of a removable hand guard.
Figure 37:
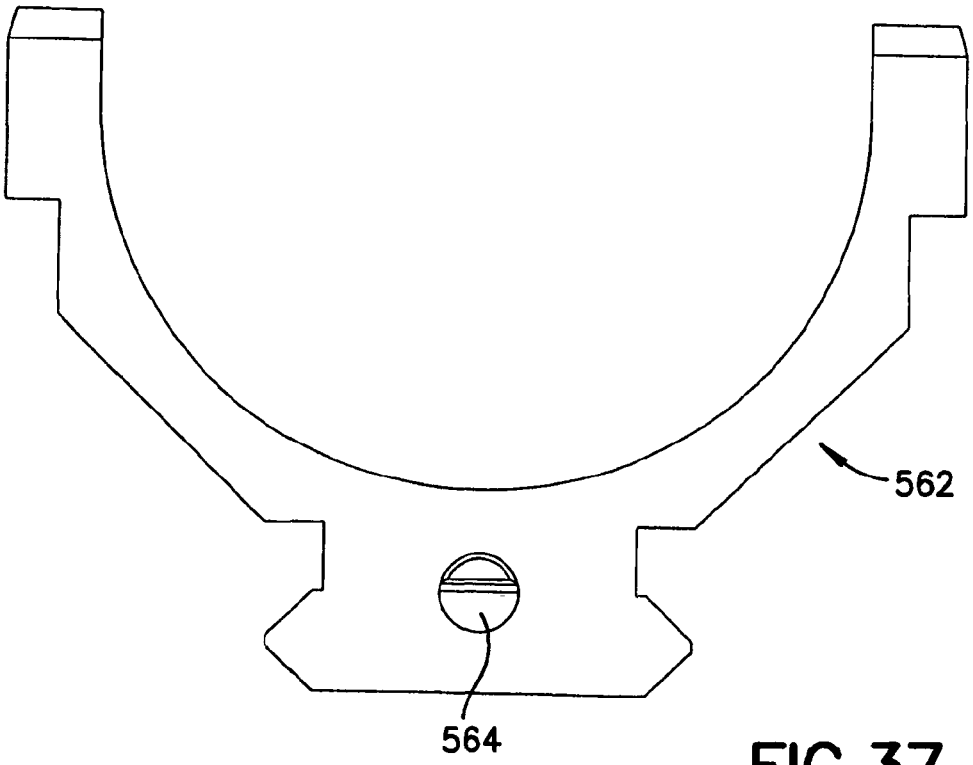
FIG. 37 is an end view of a support ring.
Figure 38:
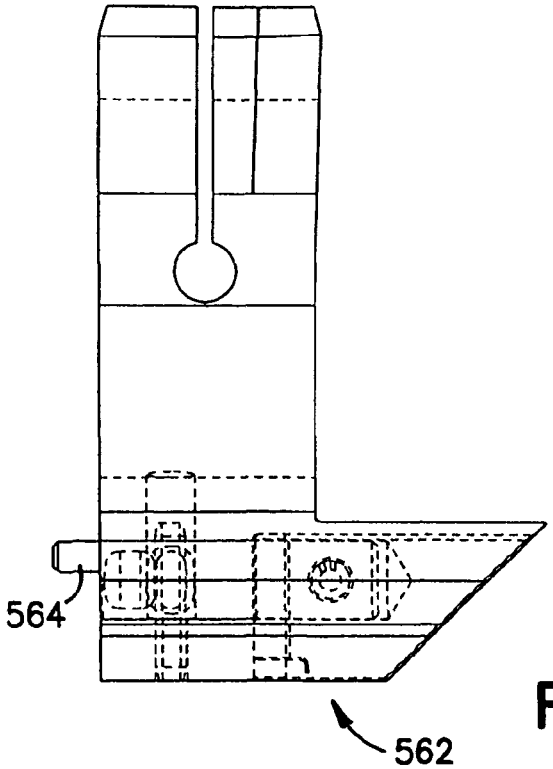
FIG. 38 is a side view of a support ring.
Figure 39:
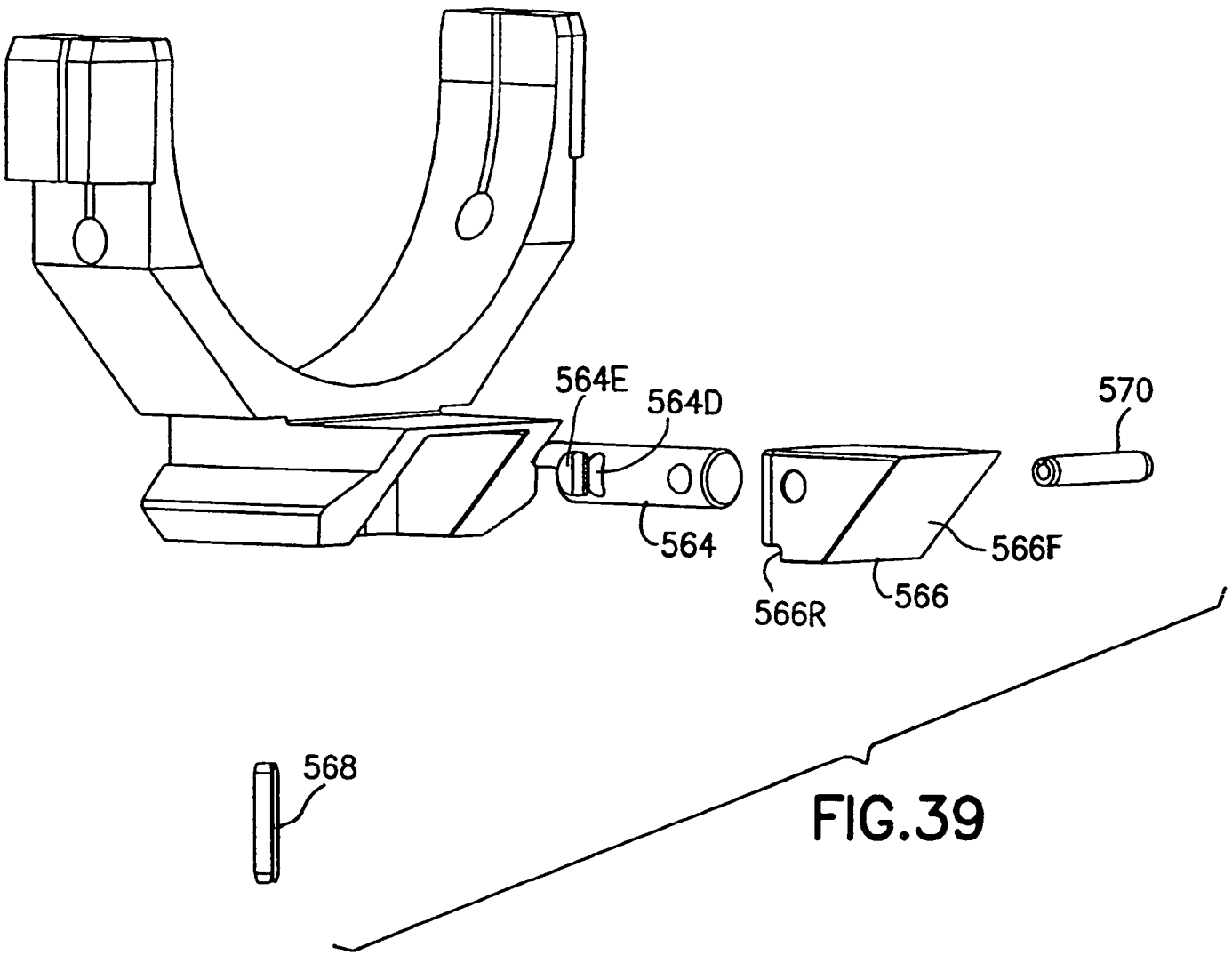
FIG. 39 is an exploded isometric view of a support ring.

Referring now to FIG. 36, there is shown an exploded isometric view of a removable hand guard 552 in accordance with another exemplary embodiment. In this exemplary the hand guard 552 is locked with a quick release lock having wedge 562. Referring also to FIG. 37, there is shown an end view of the wedge. Referring also to FIG. 38, there is shown a side view of the wedge with latch assembly shown in phantom. Referring also to FIG. 39, there is shown an exploded isometric view of the wedge and latch. The embodiment shown is generally similar in operation to lower portion 296 of FIG. 26, however employing a wedge block latch. As may realized from FIG. 36, the wedge is positioned between hand guard 552 and front support ring 576 on the upper hand guard integral with the receiver. The wedge 562 thus wedges the removable hand guard 552 against the receiver. Here, latch member 564 is located in wedge 562, for example to engage with a mating recess 560 in guard 552. Tongues 572 are provided for mating with corresponding grooves 574 of the upper receiver. Here, latch 564 is retained in wedge 562 by a flex pin 568.

As seen in FIGS. 38, 39, in this embodiment the latch member 564 has a "push/pull" button tab 566 pinned to the latch member 564 by pin 570. The button tab has a push surface 566F and a recess 566R forming a "pull" surface opposite the push surface. The button may be located in a groove of the wedge. As may be realized, a user pushing on push surface 566F urges the latch member 564 into the engaged position shown in FIG. 38, in which the latch (engaged to the guard) locks the wedge 562 to the guard section 552 (thereby preventing the wedge from being withdrawn from between the guard and front support ring). To release the latch 564 (e.g. move the latch to the disengaged position), the user pulls against recess 566R of the button withdrawing the latch from the removable guard. Latch 564 has a spring loaded detent holding the latch in both the engaged and disengaged position. In the exemplary embodiment, the latch member has recesses 564E, 564D, corresponding to its engaged and disengaged positions, that receives the flex pin 568.

Figure 40:
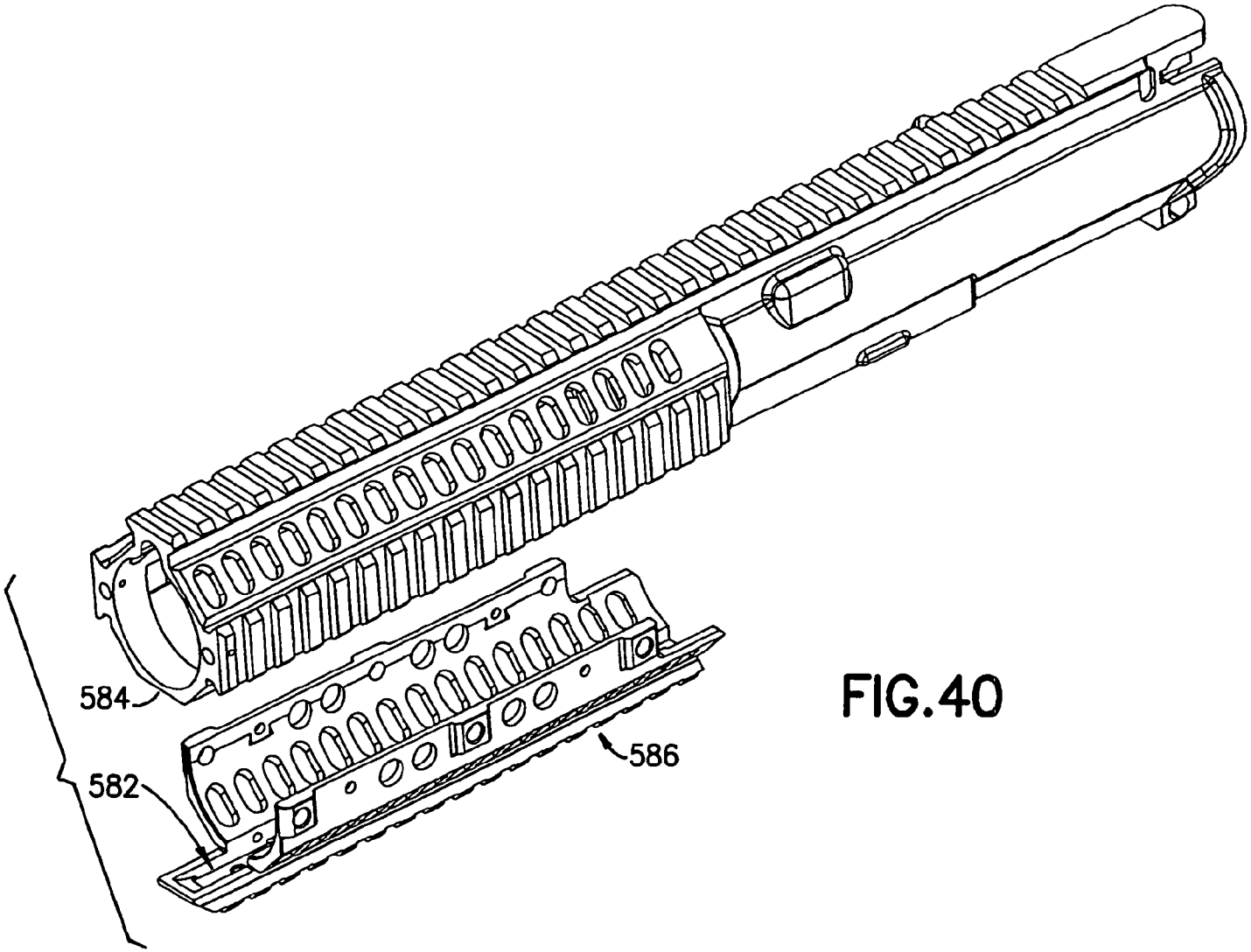
FIG. 40 is an exploded isometric view of a removable hand guard.

Referring now to FIG. 40, there is shown an exploded isometric view of an alternate embodiment removable hand guard. The embodiment shown is similar in operation to lower portion 296 of FIG. 26, however employing a quick release lock having front latch 582 that may engage support ring 584. Here, a front extension of lower portion 580 extends under support ring 584. As lower rail 580 is pushed into installed position, latch 582 engages a mating feature in front support ring 584.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A hand guard for a firearm automatic or semi-automatic rifle having an upper receiver, a lower receiver and a barrel, the hand guard comprising:

a hand guard section removably connected to the upper receiver via a locking mechanism pivotally mounted to the hand guard section and configured for movement between a locking position and an unlocking position wherein the locking mechanism requires only a single movement in one direction to move from the locking position to the unlocking position, the hand guard section having at least one peripheral device mounting rail located thereon, wherein the hand guard section has peripheral device mounting rails located at a six o'clock position with respect to a centerline of the barrel wherein the hand guard section is capable of being completely detached and removed from the upper receiver after the locking mechanism has been moved into the unlocking position.

2. The hand guard of claim 1, further comprising a heat shield mounted within the hand guard section.

3. The hand guard of claim 1, wherein the hand guard section has venting holes for cooling air to pass therethrough.

4. An automatic or semi-automatic rifle, comprising:

a hand guard section removably connected to an upper receiver via a locking mechanism pivotally mounted to the hand guard section and configured for movement between a locking position and an unlocking position wherein the locking mechanism requires only a single movement in one direction to move from the locking position to the unlocking position, the hand guard section having at least one peripheral device mounting rail located thereon wherein the hand guard section is capable of being completely detached and removed from the upper receiver after the locking mechanism has been moved into the unlocking position;

a firing mechanism located within the upper receiver;

a barrel connected to the receiver;

a barrel extension cooperating with the barrel, wherein the barrel extension has a pin configured to provide a limit of movement of an extractor of the rifle; and a gas piston operating system assembly connecting the barrel to the receiver for cycling the firing mechanism in automatic or semi-automatic operation; wherein the gas piston operating system is removable as a unit from the barrel and receiver.

5. The rifle of claim 4, wherein the gas piston operating system assembly has a cylinder sleeve, and the barrel has a gas block with a bore adapted to removably receive the cylinder sleeve therein.

6. The rifle of claim 5, wherein the gas block has a gas passage communicating with a barrel bore, and the cylinder sleeve has a gas inlet port, and wherein the gas block and cylinder sleeve are indexed with respect to each other so that when the cylinder sleeve is installed in the gas block, the gas passage and gas inlet port are communicably connected.

7. The rifle of claim 5, wherein the gas piston operating system assembly has a piston and rod assembly comprising a piston, an operating rod and return spring attached to each other to form an integral unit so that the piston and rod assembly is removably mated to the cylinder sleeve as a unit.

8. The rifle of claim 7, wherein the firing mechanism has a bolt carriage assembly with an impingement surface engaged by the operating rod.

9. The rifle of claim 6, wherein the cylinder sleeve is removably coupled to the gas block with a lock pin, wherein the lock pin defines a camming surface camming the cylinder sleeve to seal the gas inlet port to the gas passage in the gas block.

10. The rifle of claim 5, wherein the cylinder sleeve comprises an index pin, and wherein the gas block comprises a camming surface and wherein the cylinder sleeve is positioned in gas block with the index pin engaging the camming surface, and wherein engagement between the index pin and camming surface cams the cylinder sleeve out from the gas block.

11. An automatic or semi-automatic rifle, comprising:

an upper receiver;

a lower receiver;

a barrel;

a hand guard section removably connected to the upper receiver via a locking mechanism pivotally mounted to the hand guard section and configured for movement between a locking position and an unlocking position wherein the locking mechanism requires only a single action to move from the locking position to the unlocking position, the hand guard section having at least one peripheral device mounting rail located thereon, wherein the hand guard section is capable of being completely detached and removed from the upper receiver after the locking mechanism has been moved into the unlocking position; and a support fixedly coupled to the firearm; a movable sight pivotally coupled to the support and movable relative to the support between raised and stowed position; and a spring loaded detent adapted to position and stably hold the movable sight in the raised position substantially without play.

12. The automatic or semi-automatic rifle as in claim 11, wherein the support comprises a gas block.

13. The automatic or semi-automatic rifle as in claim 11, wherein the sight is located without play by the detent relative to the support when in the raised position and in the stowed position.

14. The automatic or semi-automatic rifle as in claim 11, wherein the support comprises a flat, and wherein the sight comprises a locating step, and wherein the locating step is preloaded against the flat by the detent when in the raised position.

15. The automatic or semi-automatic rifle as in claim 11, wherein the sight is pivotally coupled to the support via a pin and the spring loaded detent is a plurality of spring biased balls located within a plurality of holes in the support, wherein the plurality of holes in the support are positioned about the pin.

16. The automatic or semi-automatic rifle as in claim 15, wherein the sight further comprises a plurality of holes configured to partially receive the plurality of balls as the sight moves between the stowed and raised positions.

17. The automatic or semi-automatic rifle as in claim 16, wherein the plurality of holes of the sight are offset from the plurality of holes in the support.

18. The automatic or semi-automatic rifle as in claim 11, further comprising: a barrel extension cooperating with the barrel, wherein the barrel extension has a pin configured to provide a limit of movement of an extractor of the rifle.

* * * * *